US011679319B2

(12) United States Patent
Ramirez

(10) Patent No.: US 11,679,319 B2
(45) **Date of Patent: *Jun. 20, 2023**

(54) SPORT GLOVES

(71) Applicant: John Ramirez, Redlands, CA (US)

(72) Inventor: John C. Ramirez, Redlands, CA (US)

( * ) Notice: Subject to any disclaimer, the term of this patent is extended or adjusted under 35 U.S.C. 154(b) by 169 days.

This patent is subject to a terminal disclaimer.

(21) Appl. No.: 17/187,870

(22) Filed: Feb. 28, 2021

(65) Prior Publication Data

US 2021/0197067 A1 Jul. 1, 2021

Related U.S. Application Data

(63) Continuation-in-part of application No. 16/045,695, filed on Jul. 25, 2018, now Pat. No. 10,967,242, which is a continuation-in-part of application No. 15/012,215, filed on Feb. 1, 2016, now Pat. No. 10,137,354, which is a continuation of application No. 13/923,099, filed on Jun. 20, 2013, now Pat. No. 9,248,364.

(51) Int. Cl.
*A63B 71/14* (2006.01)
*A41D 19/015* (2006.01)

(52) U.S. Cl.
CPC ..... *A63B 71/146* (2013.01); *A41D 19/01547* (2013.01)

(58) Field of Classification Search
CPC ..... A63B 71/146; A41D 19/01547; A41D 19/0013
See application file for complete search history.

(56) References Cited

U.S. PATENT DOCUMENTS 1,358,823 A * 11/1920 Burden ..... A41D 19/015 2/21
1,358,824 A * 11/1920 Burden ..... A41D 19/015 2/21
1,716,221 A * 6/1929 Fernie ..... A63B 71/146 D29/113
1,915,617 A * 6/1933 Harley ..... A63B 71/146 D29/113
2,011,362 A * 8/1935 Hayward ..... A63B 71/146 473/59
2,120,406 A * 6/1938 Hansen ..... A41D 19/01547 264/306
2,327,836 A * 8/1943 Willard ..... A63B 71/146 132/73
2,379,430 A * 7/1945 Frost ..... A63B 71/146 2/161.2
2,751,598 A * 6/1956 Romeo ..... A63B 71/146 2/161.3
3,387,306 A * 6/1968 Korey ..... A63B 71/146 2/159

(Continued)

*Primary Examiner* — Khaled Annis

(57) ABSTRACT

According to the various features characteristics and embodiments of the present invention which will become apparent as the description thereof proceeds, the present invention provides partially fingered gloves intended to increase the overall performance in sports activities including but limited to golf. Primarily because of its unique finger configurations or apertures, the present invention makes a glove more operable in various sports activities, including for those who play Golf using the conventional interlocking grip.

20 Claims, 20 Drawing Sheets

(56) References Cited

U.S. PATENT DOCUMENTS 3,394,408 A * 7/1968 Bush ..... A63B 71/146 473/205
3,501,773 A * 3/1970 Stansberry ..... A63B 71/148 473/59
3,508,280 A * 4/1970 Osborn ..... A63B 71/146 2/161.3
3,649,967 A * 3/1972 Millman ..... A41D 19/01547 2/161.3
3,739,400 A * 6/1973 Colehower ..... A41D 19/015 2/161.6
4,131,952 A * 1/1979 Brenning, Jr. ..... A41D 19/015 2/124
4,164,043 A * 8/1979 Fujita ..... A63B 71/00 2/161.1
4,408,358 A * 10/1983 Swan ..... A41D 19/0055 2/161.1
4,519,097 A * 5/1985 Chappell, Jr. ..... A41D 19/015 2/163
4,561,122 A * 12/1985 Stanley ..... A41D 19/01523 2/167
4,651,350 A * 3/1987 Dawiedczyk ..... A41D 19/0017 2/163
4,654,895 A * 4/1987 Peters ..... A41D 19/0017 2/161.1
4,665,565 A * 5/1987 Odom ..... A63B 71/146 273/DIG. 30
4,691,387 A * 9/1987 Lopez ..... A63B 71/141 2/160
4,964,174 A * 10/1990 Martin ..... A41D 19/015 2/163
5,175,886 A * 1/1993 Suk ..... A63B 71/146 2/161.2
5,184,353 A * 2/1993 Goldwitz ..... A63B 71/146 2/160
5,228,142 A * 7/1993 Yoswein-McGreen ..... A41D 19/00 2/21
5,353,439 A * 10/1994 Kurtz ..... G06C 1/00 116/225
5,365,609 A * 11/1994 Herzog ..... A63B 71/146 2/160
5,390,372 A * 2/1995 Hashimoto ..... A63B 71/146 2/164
5,500,956 A * 3/1996 Schulkin ..... A63B 71/148 2/161.3
5,511,247 A * 4/1996 Block ..... A63B 71/146 2/160
5,575,008 A * 11/1996 McBride ..... A41D 19/01523 2/161.1
5,664,260 A * 9/1997 Weiser ..... A63B 71/146 2/161.3
5,675,839 A * 10/1997 Gordon ..... A41D 19/01523 2/163
5,742,942 A * 4/1998 Sykes ..... A63B 71/146 2/161.4
5,768,711 A * 6/1998 Wissink ..... A41D 19/0034 2/163
5,829,057 A * 11/1998 Gunn ..... A43B 11/00 2/243.1
5,829,061 A * 11/1998 Visgil ..... A41D 19/0013 2/163
5,991,926 A * 11/1999 Lakusiewicz ..... A63B 71/148 2/163
6,029,276 A * 2/2000 White ..... A41D 19/01529 2/163
6,044,494 A * 4/2000 Kang ..... A41D 19/01558 2/161.3
6,049,022 A * 4/2000 Tseng ..... A63B 71/14 602/41
6,049,910 A * 4/2000 McCarter ..... A63B 71/148 2/163
6,055,669 A * 5/2000 Albert ..... A63B 71/148 2/161.1
6,081,928 A * 7/2000 Bourne ..... A41D 19/0055 2/163
6,154,885 A * 12/2000 Kobayashi ..... A63B 71/146 2/161.3
6,189,150 B1 * 2/2001 Jones-Roberson ..... A41D 19/01529 2/163
6,216,276 B1 * 4/2001 Eibert ..... A63B 71/146 2/161.2
6,272,686 B1 * 8/2001 Liu ..... A63B 71/146 2/161.1
6,279,163 B1 * 8/2001 Hale ..... A63B 21/065 2/160
6,279,166 B1 * 8/2001 Schild ..... A41D 19/02 2/163
6,338,163 B1 * 1/2002 Markson ..... A41D 19/0017 2/163
6,408,442 B1 * 6/2002 Kang ..... A41D 19/01547 2/167
6,421,836 B1 * 7/2002 Park ..... A63B 71/146 2/161.4
6,427,248 B1 * 8/2002 Albert ..... A41D 19/01558 473/59
6,427,249 B1 * 8/2002 Mattesky ..... A41D 19/01505 2/161.6
6,539,551 B1 * 4/2003 Jones, Jr. ..... A63B 71/146 2/161.2
6,553,571 B1 * 4/2003 Guenther ..... A63B 71/143 2/161.1
6,553,574 B1 * 4/2003 Hall, Jr. ..... A63B 21/065 2/160
6,553,575 B1 * 4/2003 Davenport ..... A63B 57/353 2/161.1
6,618,860 B1 * 9/2003 Sullivan ..... A41D 19/01523 2/161.1
6,651,255 B1 * 11/2003 Schild ..... A41D 19/015 2/163
6,675,392 B2 * 1/2004 Albert ..... A63B 71/148 2/161.1
6,725,465 B2 * 4/2004 Taylor ..... A63B 69/0059 2/163
6,729,979 B1 * 5/2004 Sullivan ..... A63B 69/0071 2/163
6,810,531 B1 * 11/2004 Lento ..... A41D 19/0037 2/161.1
6,912,731 B2 * 7/2005 Cass ..... A63B 71/148 2/160
6,952,838 B1 * 10/2005 Gillette ..... A41D 19/015 2/160
7,062,791 B2 * 6/2006 Gold ..... A41D 19/02 2/163
7,210,172 B2 * 5/2007 Adams, Jr. ..... A63B 21/4025 2/21
7,237,273 B2 * 7/2007 Hernandez ..... A41D 19/015 2/163
7,469,426 B2 * 12/2008 Roeckl ..... A41D 19/01523 2/161.6
7,735,153 B1 * 6/2010 Romiti ..... A41D 19/01558 2/163
7,758,526 B2 * 7/2010 DeGould ..... A61B 5/6826 128/880
7,882,571 B2 * 2/2011 Robba ..... A63B 71/146 2/161.1
8,205,269 B2 * 6/2012 Anderson ..... A63B 71/146 2/163
8,261,372 B2 * 9/2012 Drab ..... A63B 71/146 2/161.3
8,312,567 B1 * 11/2012 Valle ..... A63B 21/4019 2/161.1
8,313,471 B2 * 11/2012 Hendricks ..... A41D 19/0017 2/21
8,376,872 B1 * 2/2013 Murphy ..... A63B 57/207 473/131

(56) References Cited

U.S. PATENT DOCUMENTS 8,397,313 B2 * 3/2013 Bevier ..... A63B 71/148 2/160
8,413,265 B1 * 4/2013 Hoppes ..... A41D 19/0024 2/160
8,458,817 B1 * 6/2013 Babb ..... A41D 19/0013 2/163
8,485,921 B2 * 7/2013 Ramirez ..... A41D 19/0017 473/409
9,248,364 B2 * 2/2016 Ramirez ..... A63B 71/146
10,137,354 B2 * 11/2018 Ramirez ..... A63B 57/207
10,967,242 B2 * 4/2021 Ramirez ..... A41D 19/01547
2001/0044950 A1 * 11/2001 Sajovic ..... A41D 19/01547 2/168
2003/0037364 A1 * 2/2003 Albert ..... A63B 71/148 2/161.1
2003/0208833 A1 * 11/2003 Gold ..... A41D 19/02 2/161.1
2004/0025224 A1 * 2/2004 Albert ..... A41D 19/01558 2/159
2004/0081801 A1 * 4/2004 Albert ..... A63B 71/148 428/343
2005/0191920 A1 * 9/2005 Sadato ..... B32B 27/12 428/319.3
2005/0204451 A1 * 9/2005 Plut ..... A41D 19/0055 2/161.6
2006/0015983 A1 * 1/2006 Kim ..... A63B 71/146 2/161.2
2006/0105851 A1 * 5/2006 Pine ..... A63B 71/146 473/201
2006/0143767 A1 * 7/2006 Yang ..... B32B 7/04 442/76
2006/0150356 A1 * 7/2006 Tayler ..... B43L 21/00 15/227
2007/0028357 A1 * 2/2007 Adams, Jr. ..... A63B 23/16 2/163
2007/0067891 A1 * 3/2007 Schauffele ..... A63B 71/146 2/161.1
2007/0150999 A1 * 7/2007 Brown ..... A41D 19/01523 2/159
2007/0226873 A1 * 10/2007 Mattesky ..... A41D 19/0058 2/159
2007/0245455 A1 * 10/2007 Robba ..... A63B 71/146 2/161.6
2008/0120754 A1 * 5/2008 Raymond ..... A41D 19/01558 2/167
2008/0189827 A1 * 8/2008 Bauer ..... G06F 3/014 2/161.2
2008/0244808 A1 * 10/2008 Chaen ..... A63B 71/146 2/163
2008/0276348 A1 * 11/2008 England ..... A63B 71/146 2/160
2009/0139008 A1 * 6/2009 Drab ..... A63B 71/146 2/161.3
2009/0182387 A1 * 7/2009 Liu ..... A41D 19/00 607/1
2009/0271905 A1 * 11/2009 Alexander ..... A41D 19/01529 2/167
2009/0313742 A1 * 12/2009 Smeltzer ..... A41D 27/28 2/167
2009/0320178 A1 * 12/2009 Faulconer ..... A63B 71/141 2/161.1
2010/0043120 A1 * 2/2010 Lee ..... A61B 42/10 2/161.7
2010/0077526 A1 * 4/2010 Smeltzer ..... A63B 71/148 2/163
2010/0122396 A1 * 5/2010 Kato ..... A41D 19/01547 2/163
2010/0175163 A1 * 7/2010 Litke ..... F16G 11/12 2/161.4
2010/0186140 A1 * 7/2010 Ramirez ..... A41D 19/0017 2/163
2011/0035861 A1 * 2/2011 McDonald ..... A41D 19/01558 2/163
2011/0197336 A1 * 8/2011 Suk ..... A41D 19/01582 2/161.3
2011/0265238 A1 * 11/2011 Choi ..... A41D 19/01523 2/16
2011/0265244 A1 * 11/2011 Anderson ..... A63B 71/146 2/161.2
2012/0042438 A1 * 2/2012 Ramirez ..... A41D 19/0017 2/161.1
2012/0084900 A1 * 4/2012 Ramirez ..... A41D 19/0017 2/161.1
2012/0137401 A1 * 6/2012 Ramirez ..... A41D 19/0017 2/161.1
2012/0227157 A1 * 9/2012 Kleinert ..... A41D 13/081 2/161.1
2013/0061369 A1 * 3/2013 Lim ..... A63B 71/146 2/161.2
2013/0191961 A1 * 8/2013 Litke ..... A63B 71/146 2/161.2
2013/0276205 A1 * 10/2013 Madore ..... A42B 1/0182 2/160
2013/0281234 A1 * 10/2013 Ramirez ..... A41F 1/06 2/161.1
2013/0283497 A1 * 10/2013 Tamaribuchi .... A41D 19/01547 2/159
2013/0318684 A1 * 12/2013 Mintoft ..... A41D 19/01547 2/163
2014/0026281 A1 * 1/2014 Kleinert ..... A63B 71/146 2/163
2014/0189925 A1 * 7/2014 Ramirez ..... A41D 19/0013 2/163
2020/0037683 A1 * 2/2020 Ramirez ..... A41D 19/01523

* cited by examiner

The interlocking grip (RELATED ART)

(RELATED ART)

SPORT GLOVES

FIELD OF THE INVENTION

The present invention relates to sports apparatus and equipment, and uses thereof, used in playing the game of various sports. The present invention and its glove embodiments enhance the overall performance in athletic tasks and/or execution commonly associated during sports play, particularly in, but not limited to golf by configuring to meet the specific requirements of a golfer's weak hand, for example. The present invention unique finger configurations generally completely cover the thumb as well as the middle, ring and pinkie fingers of a user's hand, including the fingertips. Furthermore, the present invention is configured to leave uncovered at least a portion of the distal phalanx of a user's forefinger. Additionally, some embodiments may offer grip enhancers on the palm area, the thumb segment and/or on any existing finger segments, and/or provide an aperture along the middle finger digital segment.

BACKGROUND OF THE INVENTION

An important goal in playing sports is to win. Often that means proper play execution, good ball control, good grip and feel, and proper form in the sports fundamentals. Gloves and other types of hand covers are permitted in most sports. Many individuals use gloves to enhance, in some way, their competitive edge. Indeed, gloves have become so important that different types of gloves have been created for different sports. Even within a sport, different types of gloves have been invented to, among other things, maximize performance in specific tasks.

The use of gloves can increase performance especially when the user needs to grip an object like a ball or golf club, for example. Although generally useful, using prior art conventional gloves in some sports can come with significant drawbacks, especially if users must use their hands to feel in addition to simply grip an object.

In Golf for example, a golfer grabs a golf club with both hands, and must use his or her hands to grip as well as 'feel' the golf club throughout the golf swing.

This ability to feel is critical when swinging a golf club. Once a golfer begins a golf swing, the golfer cannot lose sight of the golf ball until impact occurs with the golf ball. Consequently, the golfer must use tactile sensations on the hands to feel if the golf club is on the correct swing plane throughout the golf swing. Once the golf swing begins, the golfer can no longer look at the golf club and must continue to look at the golf ball.

This need to feel the golf club with a hand has therefore resulted in golfers having to make a difficult choice. Although clearly these players would benefit from added grip enhancers on their hands to increase their control and accuracy, prior art gloves force a golfer to choose between all feel and no feel.

Playing the sport of golf without the help of gloves, however, can also be an inferior choice. Quite often a golfer's success requires swinging the golf club to produce significant club speed, especially when teeing off at the beginning of each hole. As the velocity of the golf club increases, it becomes increasingly more difficult to maintain a tight grip on the club; this is especially true at the point of impact with the golf ball. Virtually all active golfers have chosen therefore to enhance grip capabilities and therefore sacrifice the ability to better feel the golf club.

Consequently, in the field of Golf, to be sure, there exists much prior art in the form of gloves for a golfer's weak (non-dominant) hand. In fact, most active golf players wear a glove on their weak hand, and go without a glove for their strong hand (if one were to go to any major store to buy golf gloves, they would be sold and packaged as a single—one glove—not sold in pairs).

More specifically, the current solution to this insoluble problem has been for virtually all golfers to use one and only one glove. This glove is always placed on the weak hand, leaving the strong hand without a glove.

Golfers have generally decided to wear a glove on their weak-hand, thereby increasing the overall grip of the weak hand but, because prior art weak-hand golf gloves are full fingered and therefore cover all of the user's fingers, the weak hand loses significant tactile capabilities. Cognizant of this major deficiency, most golfers will not wear a glove on their dominant hand, presumably to compensate for the loss of tactile sensation from wearing a glove on their weak-hand.

Although this method of gripping a golf club, by wearing only one golf glove, does provide some tactile sensation, the tactile sensation is limited to only the dominant hand so that the weak hand loses significant tactile sensations. This limitation of only allowing skin contact by the dominant hand has often resulted in several problems such as: difficulty in weak-hand and dominant hand coordination because skin contact between hands is blocked by the glove; difficulty in assessing proper golf club positioning by the weak-hand throughout the golf swing; and difficulty in getting proper feedback from weak-hand sensations if one completes an improper golf swing.

It is no surprise that golfers often have difficulty landing a golf ball on the fairway, even at the highest performance levels, and currently remains an insoluble problem in the sport for amateurs and professionals alike.

There is, therefore, a long-standing need to invent a device—and improve prior art—that could offer some 'feel' ability on the weak hand, without significantly diminishing that enhanced grip ability that gloves offer. The result would of course significantly improve the current challenging method of swinging a golf club and increase overall hand control of a golfer's club swing, and greater success in competition.

One very popular golf club grip, for example, is called the interlocking grip. When you use this grip, the forefinger of the golfer's weak-hand is placed over and wrapped around the strong (dominant) hand's pinkie finger. With this grip, clearly the role of the interlocked fingers has less to do with grip and more to do with coordination and feel between the user's two hands to more effectively control the golf swing and to provide greater overall golf swing consistency. There is, therefore, no real need to cover all of the weak hand's forefinger, which touches the dominant hand's interlocked pinkie finger, and uncovering at least part if not all of the forefinger would actually significantly increase overall coordination by allowing the now uncovered portion of the weak hand's forefinger to touch the skin of the dominant hand's pinkie finger. Embodiments of the present invention would therefore offer significant improvements to prior art by offering a glove which leaves at least the fingertips of the forefinger uncovered thereby offering heightened tactile sensations on the weak hand of a user.

The present invention will provide a glove for the weak hand whereby the user may both better grip a golf club as well as maintain enhanced tactile sensitivities on parts of the otherwise gloved hand.

There are other configuration challenges in prior art golf gloves that hinder those desiring to have a proper, consistent golf swing using a conventional golf grip.

Most conventional golf gloves, for example, have ventilation recesses along the dorsal portion of the digital segments including on the forefinger which of course can be counterproductive and problematic especially when gripping a golf club using the interlocking grip. Conventional golf gloves provide recesses on the proximal phalanx of the forefinger which of course channel perspiration to this area, albeit small amounts. This is problematic because the strong hand's pinkie finger interlocks and resides over the forefinger's proximal phalanx. Intentionally trying to channel moisture to this interlocked area will clearly cause unnecessary slipping between the two interlocked fingers and further hinder the user's ability to perform a unison, coordinated golf swing.

On the other hand, without any recesses on the forefinger segment, moisture will inevitably build up within the forefinger segment, making it very uncomfortable for the user; if, however, the distal phalanx of the forefinger is uncovered, for example, any moisture buildup in the forefinger segment will naturally flow out from the uncovered portion and away from the critical interlocked or overlayed portion.

For the same reasons, recesses along the middle finger's proximal phalanx may be counterproductive as well.

Solving these unrecognized problems, as embodiments of the present invention provides, will go a long way to significantly enhance consistent golf swing control, especially during hotter weather conditions. Some embodiments include a forefinger segment without any moisture management recesses along the proximal phalanx on the forefinger segment and/or along portions of the middle finger segment, where the strong hand's pinkie finger usually rests on the weak hand.

Providing a more strategic moisture management system will create a firmer contact between the fingers of both hands, and therefore a more controlled golf swing.

There is also a long existing need for a device that could offer better hand coordination between a golfer's strong hand and weak hand without significantly diminishing a golfer's ability to adequately grip the golf club. Golfers often have to fight completing a 'slice.' When a golfer hits a slice, the golf ball flies to far outside (far right for a right-handed golfer or far left for a left-handed golfer).

A slice can take place for several reasons. One reason has to do with the dominant hand not moving at the same rate and angle as the weak hand during a golf swing, or not unhinging at the same time. If there is even the slightest separation between the two hands during the golf swing, the club face will not be square at impact; the resulting open face impact will inevitably result in a slice. An ideal location to help determine if there is even slight hand separation resides where the weak hand's middle finger touches the strong hand's pinkie finger. If the golfer is using prior art golf gloves, however, it is extremely difficult to feel if there is any hand separation throughout the golf swing because of the weak hand's middle finger loss of significant tactile sensations by being completely covered by the glove.

Inventing a solution to this problem could, among other things, allow for greater golf swing control and consistency by providing a golfer with significantly enhanced and immediate feedback with a golf swing, and thus create an entirely new market to support a golfer's dominant (strong) hand and weak hand coordination.

Some glove embodiments of the present invention offer an aperture along the weak hand's middle finger such that the skin of the weak hand's middle finger can touch the skin of the strong-hand's pinkie finger, thereby providing immediate and accurate feedback if there was any separation between the user's hands throughout the golf swing and make the proper adjustments. Among the results would be improving ball contact, trajectory and accuracy by minimizing hand separation throughout the golf swing.

The weak hand's middle finger requires a unique blend of grip and sensitivity capabilities. Providing added grip capabilities along the middle finger would allow a user to better maintain control; providing an aperture along the dorsal segment's proximal phalanx of the middle finger would simultaneously allow the user to maintain tactile sensitivities whereby at least a portion of the middle finger's skin would touch the weak hand.

Consequently, there are clear indications that an entirely new market exists for a device that could support a golfer's hand coordination, especially but not limited to those who play golf using the interlocking grip. In particular, there remains an unmet need that would provide multiple benefits, such as better overall grip and more coordination with both hands during the practice or play of golf, and in various other sports activities. The present invention solves the above mentioned problems by, among other things, providing a glove configured for use on the weak hand that can increase grip abilities on areas primarily responsible for the gripping a golf club, while allowing portions of the other fingers to be uncovered and able to maintain necessary feeling capabilities.

DETAIL DESCRIPTIONS OF THE INVENTION

The present invention provides a glove having dorsal (back) and palmar (front) portions for overlaying respective back and palm regions of a human hand, said dorsal and palmar portions having distal and proximal ends with a plurality of digital segments (or stalls) projecting from said distal ends. The digital segment of the thumb covers the entire thumb including the fingertip of said thumb of a user, the digital segment of the middle finger generally covers the entire middle finger including the fingertip of said middle finger of a user, the digital segment of the ring finger covers the entire ring finger including the fingertips of said ring finger of a user, and the digital segment of the pinkie finger covers the entire pinkie finger including the fingertip of said pinkie finger of a user when the glove is worn. The glove palmar portion covers the palm of the hand including all five the user's metacarpophalangeal joints of the user's hand; the glove dorsal portion covers the back of the hand. The glove also has a wrist portion that covers the wrist of a user.

Additionally, at least a portion of a user's forefinger's distal phalanx will be uncovered.

In one preferred aspect, a forefinger digital segment exists whereby only the forefinger's distal phalanx is uncovered, in its entirety, therefore a forefinger segment will exist on the embodiment that covers a user's proximal and middle phalanges.

In another embodiment, a user's forefinger is completely uncovered, therefore no forefinger segment will exist in the embodiment. In this case, the glove will comprises a glove with a body comprising a palmar portion, a dorsal portion and a distal lateral edge, wherein the palmar portion and the dorsal portion meet at the distal lateral edge. The glove will further comprise a terminal edge at the distal lateral edge of the body designed to allow a user's forefinger to extend past the terminal edge to completely expose the forefinger when the glove is worn, thereby providing a glove without a digital segment for a forefinger.

Preferably, at least a portion of the forefinger's proximal phalanx is covered creating a distal terminal edge along the glove forefinger segment of the glove, therefore a forefinger segment will exist that covers at least a portion of a user's proximal phalanx and leaves uncovered at least a portion of the distal phalanx of said forefinger such that the fingertips would be exposed to have heightened tactile sensitivities.

Accordingly, embodiments provide a novel glove that takes into account a user's preferred golf grip, such as the interlocking grip, for example, by allowing the exposed interlocked forefinger to be better able to feel the dominant hand while allowing other fingers of the gloved hand to maintain heightened grip capabilities.

In another aspect, the terminal edge whereby the user's forefinger extends past the glove and is thereby exposed, is further stitched.

Stitching along the forefinger stall opening or around the ringlet opening is important because the opening would otherwise easily tear, destroying the finger segment or ringlet and therefore the glove, making the glove inoperable. Reinforcing the edge is particularly important because of intended sport activity use such as Golf where users are constantly engaging and disengaging the glove during sports play. This constant movement of the user's hand increases stress on the integrity of the glove by the continual rubbing and twisting of the forefinger stall edge or ringlet when engaging and disengaging the glove. Stitching will also protect the glove from atmospheric moisture entering into the otherwise exposed edge material which can quickly lead to fraying and splitting thus destroying the glove and making it inoperable. Therefore the stitching is adapted to encircle the terminal edge or distal terminal edge in order to be effective at preventing tearing along the terminal edge or distal terminal edge.

In another preferred aspect, the present invention also comprises a grip enhancing means, such as PVC dots for example, on a portion or portions of the palmar surface area of the glove. Such as for example, on any thumb and finger stalls where a finger segment exists, along any portion of any metacarpophalangeal joints, and/or between the thumb and forefinger area, generally defined by the metacarpal of the forefinger and extending up along the metacarpal of the thumb, and therebetween. The grip enhancing means is adapted to provide a higher coefficient of friction than the material forming the glove palmar portion.

The grip enhancing means is therefore specifically positioned to provide enhanced grip and a higher coefficient of friction along select areas of the palmar portion of the glove. The grip enhancing means will offer a golfer multiple benefits such as increased control of a ball or device thereby enhancing performance and overall success at performing a sports task.

In at least one embodiment all of the above mentioned areas will comprise of a grip enhancing means including all five metacarpal areas of the user's hand when the glove is worn. For example, an embodiment can comprise of a grip enhancing means overlaying the entire metacarpophalangeal joints of the pinkie finger, ring finger, middle finger and forefinger when the glove is worn. The grip enhancing means is therefore be defined by overlaying the four finger digital creases and extending down about three centimeters (width) or so, enough to cover the entire metacarpophalangeal joints of said fingers in their entirety. The length would be defined by the two opposing sides of the palm. This area would then include, for example, a high friction surface or a textured surface, as the grip enhancing means thereby providing a higher coefficient of friction than the surrounding untextured palmar portion. The grip enhancing means could be comprised of a beaded surface pattern, for example, projecting out at least ½ millimeter or so, and which could be integral to the glove material, preferably extending throughout the entire designated surface area, but could certainly be provided on at least one centimeter by one centimeter along the designated outer surface to provide added grip support, such as, for example, only on the metacarpophalangeal joint of the forefinger (provided a forefinger segment exists on the particular embodiment). Enhancing the user's grip along the metacarpophalangeal joints is particularly important when playing the sport or golf or football, where much of the grip requirements exist and are needed.

In at least one embodiment, the entire palmar surface comprises a grip enhancing means throughout the glove palmar portion.

In general, the grip enhancing means of the present invention may be integral to the glove or may be affixed to the glove surface by, for example, forming a grip enhancing panel and applying the panel onto a portion of the glove. The grip enhancing means of an embodiment could comprise, for example, a high friction textured surface with a more narrow width, say about 1.5 to three centimeters, or so. This and other embodiments may include a plurality of projections or a plurality of depressions on the surface as the gripping means which is formed from, for example, one of a vinyl material, a rubber material, or a neoprene material, creating a grip enhancing panel.

The material forming the grip enhancing panel could then be applied to one or more finger stalls using any standard bonding methods, such as adhesion or stitching. The projections can preferably be provided, for example, on at least one—or only on one—phalanx of any finger stalls. In general, the grip enhancing panel may preferably be formed from an elastic material or fabric, including but not limited to, a knitted fabric, for example, lycra, rayon, neoprene, a rubber material, a vinyl material, or the like, or tackifiers and tackified materials. Once the grip enhancing surface on the panel has been formed, the grip enhancing panel may then be applied to the palmar surface of the glove by any standard methods, such as by stitches or adhesives, for example.

In general, the grip enhancing means of the present invention creates a significantly higher coefficient of friction than the surrounding material forming the palmar portion of the glove, and can be comprised of various grip-enhancing materials, forms, coatings, and designs, including but not limited to, foams, fabrics, PVC dots, perimeter patching designs, linear and non-linear grooves, or combinations thereof, high friction surfaces, textured surfaces, a plurality of regular or irregular projections, a plurality of regular or irregular depressions, non-slip materials and coatings, such as PVC coatings, nitrile coatings and latex coatings, and designs, as well as pebbled or beaded surfaces, convex or concave bumps, striations, cross-hatches, convex or concave linear and non-linear lines, angled ribs, random structures, convex or concave ridges or grooves, crevices, elongated segments, and the like, and tackifiers or tackified materials. Preferably, the depths of the depressions and/or heights of projections would be such that the gap formed by the depressions or projections would allow for some movement of the palmar surfaces thereby increasing the grip capabilities of the user. The height or depth ranges can generally begin at about 100 micrometers to several millimeters or more.

The grip enhancing means may further comprise a plurality of spaced apart stripes or striped projections formed from a high friction material, such as a PVC material, for example. Preferably the stripes comprise raised or projecting stripes and are arranged to extend generally parallel to the axis of any existing finger stalls. Stripes and other forms may be uniformly spaced or spaced at varying intervals. Similarly, stripes and other forms may have varying thicknesses, heights or depths, depending on preference. The thickness ranges generally can begin at about 100 micrometers to several millimeters or more. The grip enhancing means may create a pattern, may be in rows or randomly placed, and may form non-circular and circular shapes, such as spherical, cylindrical or elongated. Additionally, they may be individually separated or interconnected.

In general, the palmar surface of an embodiment can have a variety of finishes, one portion of the surface can have a smooth finish, for example, and another portion can have a textured surface. The textured portion creates a higher coefficient of friction, or grip enhancer, on the palmar surface of the glove.

The grip enhancing means can be formed on the glove by any standard method, for example, by embossing, stamping or molding a portion of the glove to create the gripping means. For example, the grip enhancing means can comprise of regular projections of say, about 300 micrometers in height, but may vary in height depending on preference. The projections may all be the same height, and may be in rows. They may be embossed elongated shapes that are interconnected, thus creating a high coefficient of friction throughout the entire palmar surface area of the glove. Other embodiments could of course offer different heights, non-uniform Oheights, and have a more random pattern on the palmar portions forming the glove.

The grip enhancing means preferably provides an effective coefficient of friction, preferably of a Shore A Durometer Coefficient of Friction of about 1.0 or greater; more preferably between a coefficient of friction of between 1.5 and 4.5.

Accordingly, embodiments provide a novel glove with added grip-enhancing features that substantially enhance overall control and sports performance.

Embodiments may also offer a liner or sleeve which may be integrally formed on the glove. For example, the liner (or sleeve) could be attached to the glove by standard methods, such as by conventional stitching about the perimeter of the dorsal segment.

The lining material (or sleeve) may be comprised of standard lining materials, such as a smooth, flexible knitted fabric. The liner may also comprise of flexible and elastomeric material such as spandex or LYCRA. Other possible materials include a knit of polyester or simply the same material forming the glove. A soft cellular plastic could also be preferred. Additionally, the liner may provide added features to offer warmth and comfort such as by comprising of a fleece material, for example, especially useful when competing or practicing in colder conditions (or when playing at night, which is beginning to gain in popularity).

It will be apparent to one of ordinary skill in the art that many other implementations of liners are possible.

In yet another aspect, embodiments may also comprise an aperture along the middle finger digital segment of the glove. The aperture will leave uncovered at least a portion of the middle finger segment's proximal phalanx. Accordingly, embodiments with an aperture along the middle finger stall can also provide a novel glove with features that assist a golfer significantly improve hand coordination by allowing the exposed skin of the weak hand's middle finger to touch the skin of the strong hand's pinkie finger and thereby increase hand coordination throughout a golf swing. Among the benefits of this unique configuration include heightened critical tactile sensitivities to more properly feel if there is any separation between the weak hand's middle finger and the dominant hand's pinkie finger, throughout the golf swing.

Embodiments may also have an expandable opening means at a wrist end adapted to receive the user's hand. The expandable opening means comprises an elastic material along the wrist portion, such as an elastomeric band fixed around the wrist.

An important functioning aspect of the present invention is that it comprises of a strap means. More specifically, the glove dorsal portion further comprises a strap means at the open end of the glove body dorsal portion for fastening the glove body secure about the wrist area, critical in sports activities where the user's hand moves very rapidly such as in golf or football. The strap means may have two pads of cohesive-adhesive material for releasably securing the strap. The strap as well as this wrist portion may be sewn onto the glove, for example. The strap means may also comprise a flap which mechanically engages a flap capture mechanism to secure the glove to the users hand (e.g., a synthetic hook and loop fastening interface which adheres when pressed together, commonly using VELCRO). In this case the flap could overlay a small slit or opening along a portion of the back of the hand to allow the glove to widen when a user places the glove on to the hand. The slit allows the user to quickly take off or put on the glove, and doing so very easily. The combined features of providing a slit with a strap means would be especially valuable to users who play a sport that requires the constant removal of the glove, such as in football—where players generally take off their gloves during a change of possession, and in golf—where virtually all players take off their glove when preparing to putt a golf ball.

Embodiments may also comprise of micro-recesses along any portions of the glove, generally used on golf gloves and baseball gloves for ventilation or moisture management purposes. These micro recesses are generally about 0.120 millimeters or so in diameter. These micro recesses are generally not along the proximal phalanx of the middle finger segment or the proximal phalanx of the forefinger, although some embodiments may be configured as such to meet user conventional preferences. Alternatively or additionally, recesses may reside on the glove portion overlaying one or more metacarpophalangeal joints. In at least one embodiment, an aperture will reside on a metacarpophalangeal joint segment, such as along the middle finger metacarpophalangeal joint, to provide added ventilation and added flexibility. The aperture on the metacarpophalangeal joint portions will preferably not extend beyond said joint portions, thereby defining their terminal edges.

Embodiments may further comprise a detachable golf ball marker to more easily allow a golfer to mark the spot of the golf ball's location. The detachable ball marker is secured by any standard fastening means, such as by snap fastening, by a VELCRO fastening compartment, by magnetism, or the like.

The finger segments of embodiments are preferably designed to fit snugly around a user's fingers, as are typical sports gloves. In addition, some embodiments may have material treated by a moisture repellant, for example SCOTCH GUARD or a synthetic resin, extremely useful during harsher weather conditions. Additionally, embodiments may also comprise various weather-resistant and perspirant-resistant materials, forms and designs including, but not limited to, water-resistant materials or micro-recess designs along any portion of the glove, for moisture management, or combinations thereof.

Embodiments may be made and manufactured using standard materials and methods in developing sports gloves. Materials that can comprise these glove embodiments include, but are not limited to, woven materials such as natural, synthetic or blends of natural and synthetic yarns, thermoextruded or thermoset rubbery embodiments such as those made from thermoplastic elastomers. Examples of natural materials include genuine or Cabretta leathers. Synthetic yarns include nylon, polyester, and spandex (polyurethane) yarns. Embodiments may also comprise stretch materials and designs, mesh fabrics, recycled and flexible materials, cottons, polyester, rayon, spandex, fleece, leathers and synthetic leathers, rubbers, plastics, woven fabrics, non-woven fabrics, cloths, LYCRA, a vinyl material, a neoprene material, a fleece material, or combinations thereof.

The thickness of the dorsal and palmar segments can generally begin anywhere from 0.002 inches to 0.040 inches or so as are standard sports gloves, for example, and can depend on several factors such as comfort and durability preferences. Some embodiments may offer more durable material for the dorsal surface thus requiring an even thicker dorsal segment.

Construction of the present invention may be accomplished by any standard methods, such as, for example, by designing the dorsal and palm sections to meet along a conjoining lateral edge to define a pocket for receiving the eminence of a user's hand. Other standard methods of construction could certainly be used, of course.

One sport that will clearly benefit from the present invention is Golf. The present invention will meet an unmet need by significantly and substantially improving prior art gloves for the weak hand. Currently, only full-fingered gloves are used by golfers. Prior art therefore does not allow a golfer to take complete advantage of his/her preferred grip by allowing for skin contact between both hands and thereby maximizing hand coordination throughout the golf swing.

One embodiment that would improve prior art comprises a glove that covers essentially all of the weak-hand's thumb, middle, ring and pinkie fingers, while leaving the user's forefinger completely uncovered.

Using embodiments of the present invention now allow a user playing Golf, for example, to place their covered thumb, middle finger, ring finger and pinkie finger on the golf club, and increase the grip by the glove embodiment, while being able to maintain maximum tactile abilities by leaving uncovered the user's weak hand forefinger. This and other embodiments now allow far greater feel and coordination lost with prior art especially when gripping a golf club using the conventional interlocking grip. The interlocked fingers now allow for far better feedback because both interlocked fingers are now uncovered, making it easier to adjust a golf swing. Users who prefer this embodiment will greatly benefit from maximum feel between the completely uncovered interlocked fingers of both hands.

This and other features now essentially make the sports glove more operable, novel and significantly superior to prior art, especially for those playing the sport of Golf using the popular interlocking grip.

Additionally, a grip enhancing means may be provided along the palmar surface of the glove to further increase grip capabilities, if preferred. For example the grip enhancing means may comprise a plurality of projections formed from a skid resistant material, such as neoprene, PVC, rubber or the like. The projections can form a pattern on the palmar surface. Preferably, the high friction surface includes interstices or spaces between projections to allow for necessary flexibility. Preferably, the projections have an average height of about 700 micrometers or more.

Another preferred glove embodiment that will provide superior advantages over prior art in the sport of Golf would only partially cover the user's forefinger while essentially enclosing the thumb, middle, ring and pinkie fingers.

As previously mentioned, one very popular grip is called the interlocking grip. When you use this grip, the forefinger of the golfer's weak-hand is placed over his dominant hand and is interlocked with the dominant hand's pinkie finger. With this grip, clearly the role of the weak-hand's forefinger has less to do with grip and more with coordination and feel on the strong-hand, to more effectively control the golf swing and to provide greater golf swing consistency. There is, therefore, no real need to cover all of the weak-hand's forefinger, and covering the forefinger actually diminishes said forefinger's sensitivities. Embodiments of the present invention would offer significant improvements to prior art.

This embodiment could comprise a glove that covers essentially all of the weak-hands thumb, middle, ring and pinkie fingers, while leaving the forefinger's fingertips uncovered. Specifically, for example, a forefinger digital segment would exist whereby all of the proximal and middle phalanges are completely covered. In addition, most of the distal phalanx would be uncovered, say about sixty percent, such that all of the forefinger's fingernail is completely uncovered, and extending around the palmar portion of the forefinger segment.

Users who prefer this embodiment will greatly benefit from significantly increased feel between the uncovered portions of the interlocked fingers of both hands, while still providing some grip-enhancing support along the forefinger's proximal phalanx, where the forefinger segment often touches the golf club during a golf swing.

A grip enhancing means can of course be formed on this and other embodiments. For example, a grip enhancing means can also be formed on any finger stalls or along the metacarpophalangeal joints if preferred, thus providing added grip capabilities along the area where the club is gripped. For the same reasons aforementioned, this embodiment would significantly assist golfers using any of the interlocking, for example. The grip enhancing means may comprise of stripes, for example, projecting out about 600 micrometers.

Among the benefits of the present invention include: the ability to offer greater golf consistency and accuracy by solving this previously unsolvable problem in prior art; a far more successfully coordinated golf swing; and heightened feel capabilities for better feedback if the golf club inappropriately moves during a golf swing. Using this embodiment will allow a user to maximize feel with both hands.

This embodiment may also comprise of a wrist end with a strap means to secure the glove to the user's hand. The strap means may comprise a strap or a flap which mechanically engages a flap capture mechanism (e.g., a synthetic hook and loop fastening interface which adheres when pressed together, commonly using VELCRO).

An expandable opening means may also be employed such as, for example, an elastic means such as an elastomeric band fixed around then wrist aperture. Embodiments may also have combinations of both a flap capture mechanism and an elastomeric band. The wrist portion may be formed integral with the glove or may be attached to the glove by standard methods, such as by sewing.

This and other embodiments may be primarily a leather golf glove, with the dorsal and palmar surface areas essentially covering all five metacarpals, with the exception of a slit along the dorsal surface which allows the golfer to insert the hand into the glove quickly, necessary in active sports play such as golf and football, and micro recesses along portions of the glove to allow for ventilation.

Embodiments may also offer an additional significant feature to greatly enhance golf swing performance and hand swing coordination. One modification to the embodiment just mentioned above, may, in addition to having heightened tactile sensitivities along the weak hand's forefinger, may also offer increased tactile sensitivities along the weak hand's middle finger. This heightened tactile sensitivity may be accomplished by having an aperture along the weak hand's middle finger digital segment. The aperture on the middle finger segment is preferably located to leave uncovered a portion of the proximal phalanx, thus creating one rather large aperture. This finger configuration will allow a golfer to increase their overall control of a golf swing.

When the golfer uses the interlocking grip and places the pinkie finger of his/her dominant hand around and between the uncovered Forefinger and covered middle finger of his weak-hand, the coordination from the added feel between the two hands will be enhanced with this embodiment. As the strong hand's pinkie finger wraps around and embraces the covered weak hand's covered forefinger's proximal phalanx, the pinkie finger would abut and also touch the skin of the weak hand's middle finger because of the embodiment's aperture along the middle finger segment.

This embodiment, and others, can allow a golfer to use the interlocking method to provide the usual grip capabilities on the weak hand while now providing significantly superior tactile sensations in coordinating hand movements because of the aperture. By providing this opening along this select area, the user can uniquely increase feel without losing grip capabilities along other portions of the interlocked hands.

The increased sensitivities will provide a user with significantly enhanced capabilities to coordinate a golf swing, to feel if there is even a modest amount of unnecessary movement between both hands, and to more properly adjust his or her next golf swing. Embodiments of the present invention offer these significant improvements thereby solving an unrecognized problem in prior art.

Some embodiments, of course, will not have an aperture along the middle finger segment. These embodiments that are absent of any aperture will be useful and significantly beneficial to those playing the sport of golf, primarily because the unique finger configurations of the glove, as well as because of any grip enhancing means on embodiments.

Additionally, this embodiment can have a palmar and dorsal portion overlaying a portion of the wrist area. For example, the wrist portion can be stitched on the glove and be made of an expandable composition whereby the glove expands when being placed on a hand, and then naturally readjusts to fit snugly around the user's wrists.

Finally, this and other embodiments may also provide a detachable ball marker, such a circular magnetic disc that attaches to a magnet located on the dorsal surface area of the golf glove, for example. The ball marker may be secured by any standard fastening means, such as by magnetism or snap fastening, for example. The back portion of the detachable ball marker as well as the connecting dorsal segment of the glove may both therefore have small magnets. The ball marker may be circular or non-circular in design.

The rest of the hand, front and back, can be essentially covered by the glove.

Clearly, the present invention provides users significant and substantial benefits, including but not limited to significantly improved feedback capabilities, especially when it comes to feeling if a user's hands were misaligned at any time throughout a golf swing.

The benefits of these significant and substantially different physical configurations of the present invention will inevitably create a new method of gripping a golf club. The generally accepted method of swinging a golf club is clearly a result of the limitations of prior art gloves.

The present invention will, for example, allow a user's weak hand to have heightened tactile sensitivities to have a better coordinated and proper golf swing. Once a user begins to swing the golf club, the user can have heightened sensitivities to feel if the hands suddenly are misaligned, for example. The golfer should now have a more stable overall grip, better control and enhanced performance possibilities. This improved method, of gripping and swinging a golf club by having heightened tactile sensitivities on both hands, not just with the dominant hand, will provide a user with greater overall control and consistency in a golf swing.

SUMMARY

Many features can be used in conjunction with each other to uniquely solve problems that have up until now been unsolved.

In general, embodiments of the present invention can generally be used in conjunction with any type of hand task activity and/or sports play. As discussed, embodiments offer an individual with the opportunity to increase overall hand task performance. Maintaining or increasing overall control, for example, can provide many benefits to a user of these, and other embodiments. These and other embodiments:

- offer the ability to grip as well as feel a sports device, such as a golf club
- provide a unique solution for users who desire better grip capabilities only in select areas
- offer a more stabilizing overall grip of a ball or object, by conveying significantly higher grip-enhancing capabilities to select locations of the hand
- provide significantly higher grip enhancing capabilities along the connecting area between the thumb and forefinger
- allow an individual to maintain or increase control of a ball or object along the metacarpophalangeal joints
- permit the ability to use a glove on a weak hand configured to meet the unique needs of a user's preferred golf grip, especially for those using an interlocking grip
- improve performance in hand task execution by providing heightened feel capabilities on a golfer's weak hand
- offer more control capabilities throughout a sports task, a valuable feature when striking a golf club with greater velocity
- allow more hand coordination by adjusting grip-enhancers to match a preferred particular golf swing
- decrease the likelihood of golf slices
- provide superior coordination in a golf swing
- enhance overall control and golf swing stability.
- improve tactile feedback to feel if a user's wrist moved the wrong way forward or backward—during a golf swing increase the possibility for squarer golf clubface at impact with the golf ball thereby improving ball contact, trajectory and accuracy.

allow a user to maintain grip capabilities that a glove generally provides while being able to significantly enhance tactile sensations along the same hand.

provide a much improved method of playing the sport of Golf by using a grip enhancing means not just on the weak hand but also on the strong hand as well, without limiting the feel and coordination requirements in a proper golf swing.

create a more strategically placed moisture management system that is more appropriately suited for golfers who use the interlocking or overlapping grip.

increase a more unison golf swing by allowing the user to better feel if his or her hands separate during the unhinging process.

These are among the many benefits of the present invention, and are not to be construed as limitations of the benefits nor their legal equivalent.

Although the description of the present invention only discussed two sports, it is understood that individuals playing other sports might benefit as well, such as football.

Furthermore, only some embodiments have been discussed and in no way is intended to limit all the various embodiments and other embodiments that the present invention provides, such as but not limited to, different designs or multicolors or fluorescent colors. Embodiments can of course be used by men and women, boys and girls, professional athletes or amateurs, as well as by those whose dominant hand is the right hand or the left.

BRIEF DESCRIPTIONS OF THE DRAWING

It is expressly understood that the following descriptions and drawings are for illustration purposes only, and in no way are intended to limit the scope of the present invention and its various embodiments. For example, the drawings are of embodiments for the left hand but can easily be created for the right hand.

FIG. 1 is a drawing of the palmar (front) view of an embodiment. The glove completely covers the thumb, middle finger, ring finger and pinkie finger. The glove also has a finger segment that covers the forefinger's proximal phalanx but does not extend to cover the forefinger's middle or distal phalanges.

DETAILED DESCRIPTION OF THE DRAWINGS

It is expressly understood that the drawings are for the purpose of illustration and description only and are not intended as a definition of the limits of the invention.

Figure 1:
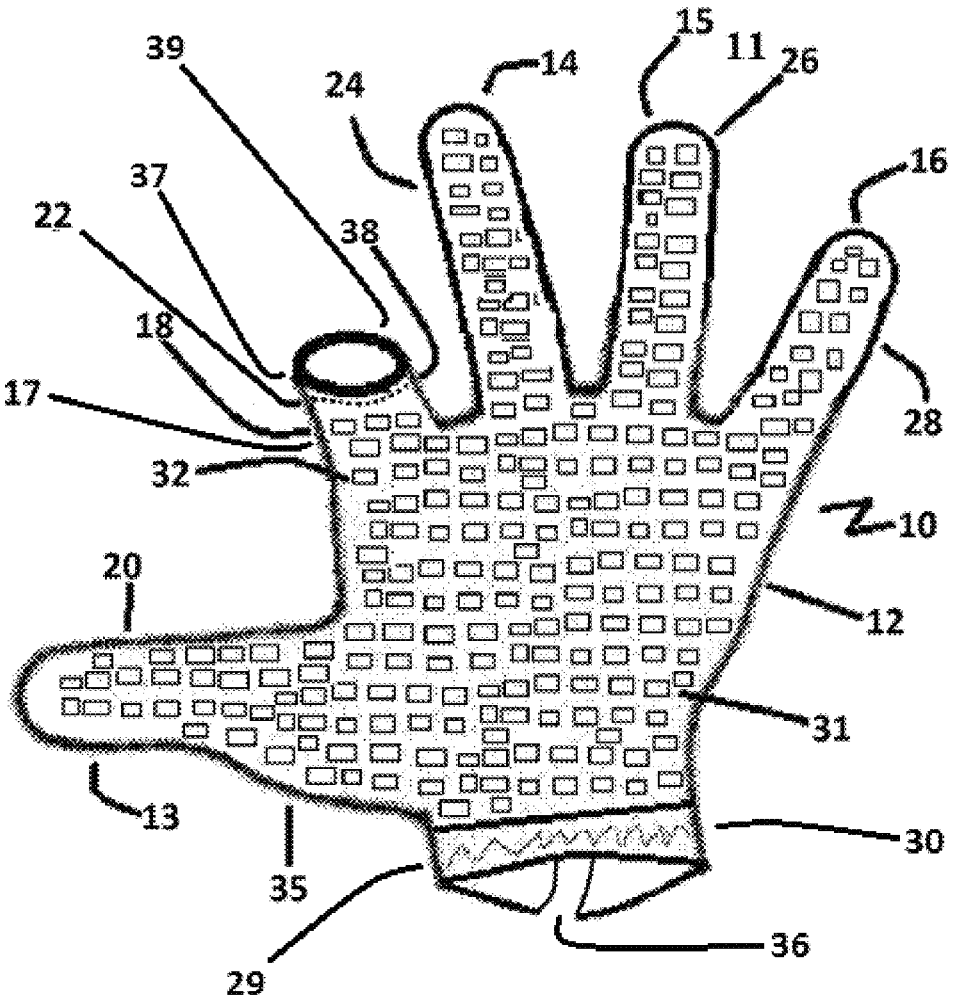
Figure 2:
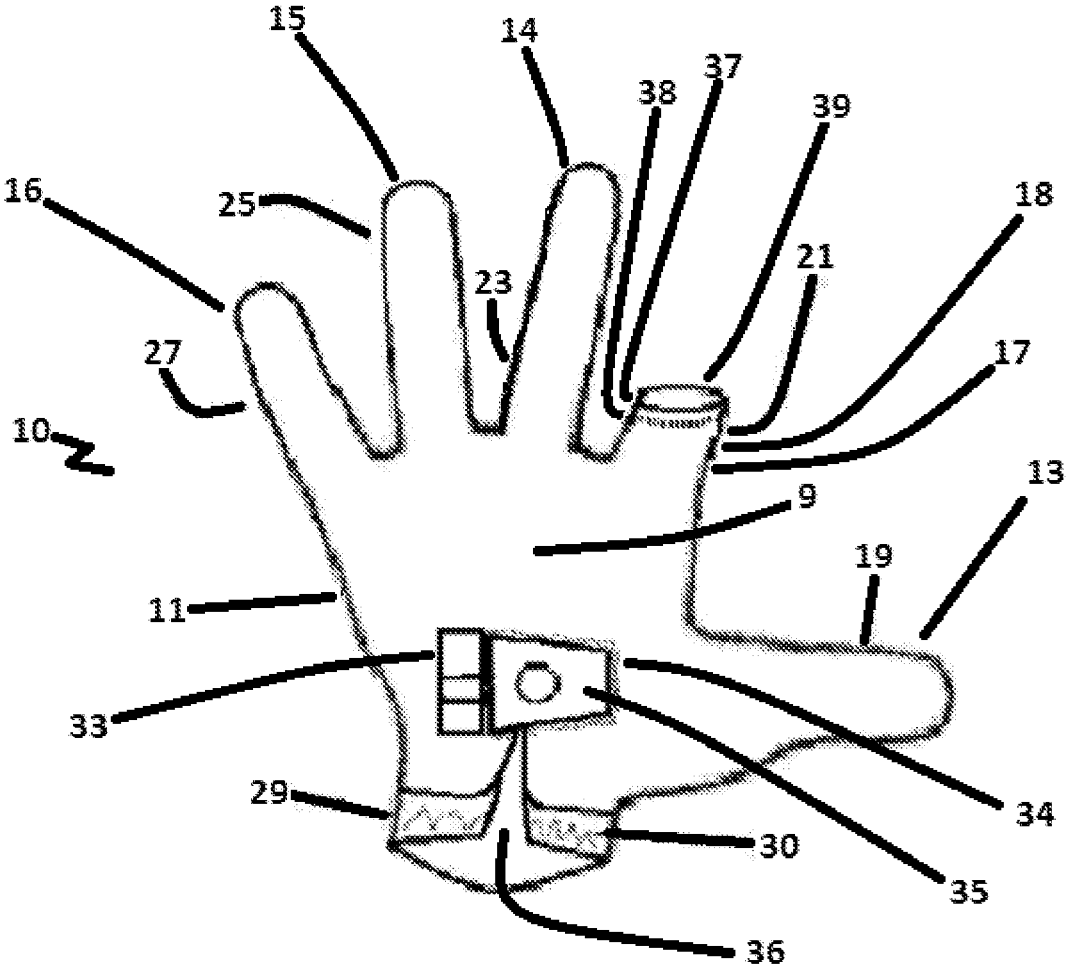
FIG. 2 is a drawing of the embodiment as described in FIG. 1, showing the dorsal (back) view.
Figure 11:
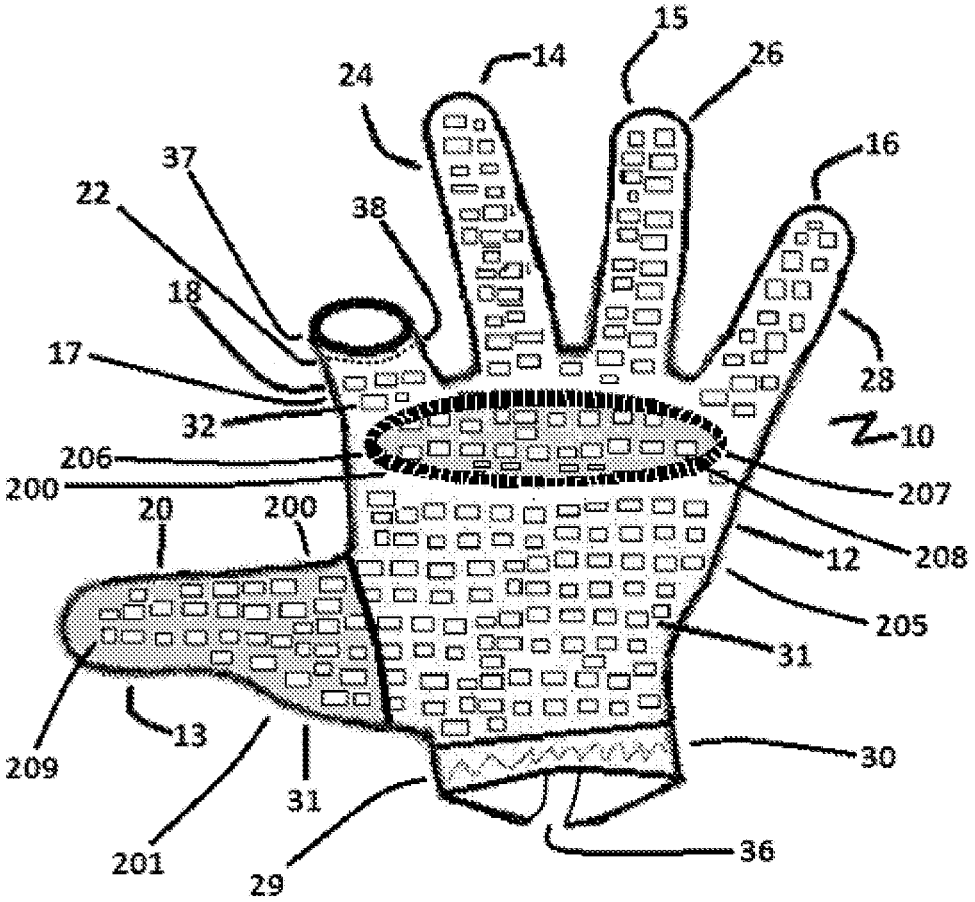
FIG. 11 is a drawing improving the palmar (front) embodiment of FIG. 1.
Figure 12:
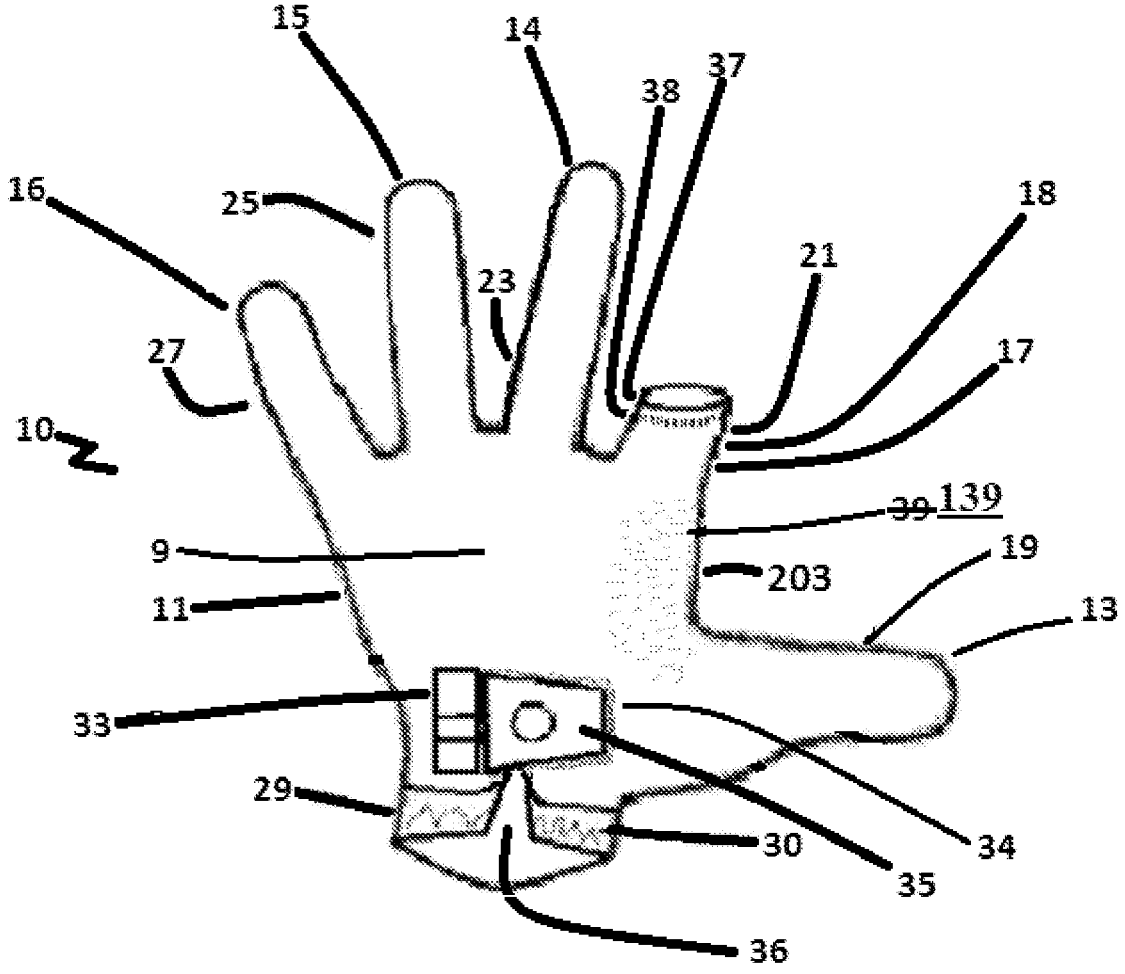
FIG. 12 is a drawing improving the the dorsal (back) embodiment of FIG. 2.

Referring now to a first embodiment of the present invention is shown and designated as 10. The palmar view of a glove is drawn in FIG. 1 and the dorsal view of the same glove is drawn in FIG. 2. Newer improvements [31, 200, 201, 203, 205, 206, 207, 208, 209 of the first embodiment are shown on FIGS. 11 & 12, which show the palmar view and the dorsal view, respectively. This partial-fingered embodiment provides a glove having a dorsal portion 11, a palmar portion 12 for overlaying respective back and palm regions of a human hand, said dorsal and palmar portions having distal and proximal ends with a plurality of digital segments (or stalls) projecting from said distal ends. The glove includes a glove body having a back portion covering the back of the hand 11, and a front portion covering the palm or front of the hand 12. The glove body includes finger stalls (or digital segments) and a thumb stall (digital segment) each adapted to receive a finger or thumb, respectively, therein.

In the illustrated embodiment the glove is constructed such that the thumb 13 digital segment encloses said thumb, including enclosing the fingertips. The glove has a middle finger digital segment 14 that encloses the middle finger, including the fingertips, a ring finger digital segment 15 that encloses the ring finger, including the fingertips, and a pinkie finger digital segment 16 that covers the pinkie finger, including the fingertips of a user. In addition, the glove has a forefinger digital segment 17 with a distal terminal edge 37. Said forefinger digital segment is adapted to extend to cover up to but not more than the proximal phalanx of the user's forefinger, such as covering a portion of the user's proximal phalanx 18 for example, therefore does not extend to cover the middle phalanx nor any portion the distal phalanx of the user's forefinger when the glove is worn, therefore defining the forefinger segment. The forefinger digital segment is adapted to expose a portion of the user's forefinger when the glove is worn, thereby allowing heightened tactile sensitivities along the fingertip and simultaneously enhancing grip capabilities along the covered proximal phalanx of the user's forefinger. Covering the proximal phalanx allows the user to maintain grip along the area where the proximal phalanx grips the golf club, while exposing the middle and distal phalanges gives the user heightened tactile sensitivities along the area where the middle and distal phalanges interlock with the opposing hand's pinkie finger, for example.

The palmar section also covers the palm segment overlaying the palm of the hand 12; the dorsal section also covers the back of the hand 11. The glove also has a wrist portion that surrounds the wrist of a user. The thumb stall 13 is defined by a dorsal portion 19 and a palmar portion 20. The forefinger stall 17 is defined by a dorsal portion 21 and a palmar portion 22. The middle finger stall 14 is defined by a dorsal portion 23 and a palmar portion 24. The ring finger stall 15 is defined by a dorsal portion 25 and a palmar portion 26. The pinkie finger stall 16 is defined by a dorsal portion 27 and a palmar portion 28.

Furthermore, the forefinger segment distal terminal edge 37 is reinforced by stitching 38. Stitching the forefinger stall along or around the opening is very important because the opening would otherwise easily tear, destroying the finger segment and therefore the glove, making the glove inoperable. Reinforcing the edge is particularly important because of intended sport activity use such as Golf where users are constantly engaging and disengaging the glove during sports play. This constant movement of the user's hand increases stress on the integrity of the glove by the continual rubbing and twisting of the forefinger stall edge when engaging and disengaging the glove. Stitching will also protect the glove from atmospheric moisture entering into the otherwise exposed edge material which can quickly lead to fraying and splitting thus destroying the glove and making it inoperable.

Therefore the stitching 38 is adapted to encircle the distal terminal edge 37 of the forefinger stall in order to be effective at preventing tearing along the forefinger distal terminal edge 37.

The wrist portion is preferably expansible so as to hold more securely to the user's wrist. Therefore the embodiment also has an expandable opening means 29 at a wrist end 30 adapted to receive the user's hand. The expandable opening means comprises an elastic material along the wrist portion, such as an elastomeric band 29 fixed around the wrist. The wrist end 30 further comprises a strap means 33 at the open end of the glove body dorsal portion for fastening the glove body secure about the wrist area, critical in sports activities where the user's hand moves very rapidly such as in golf or football. The strap means may have two pads of cohesive-adhesive material 34, 35 for releasably securing the strap. The strap means as well as this wrist portion may be sewn onto the glove, for example. The dorsal portion of the glove further comprises a slit 36. The slit 36 allows the user to quickly take off or put on the glove, and doing so very easily. These features of providing a combined slit and strap means are especially valuable to users who play a sport that requires the constant removal of the glove, such as in football—where players often take off their gloves during a change of possession, and in golf—where virtually all players take off their glove when preparing to putt a golf ball.

This embodiment further shows how the present invention may comprise a grip enhancing means 31, 200. Although the embodiment now provides a higher coefficient of friction on a golfer's weak hand, one may now further increase grip areas by adding a grip enhancing means on select areas or on the entire palmar surface of the glove and is adapted to provide a higher coefficient of friction than the material forming the palmer portion of the glove body.

In the illustrated embodiment, the grip enhancing means comprises a high friction surface 31 formed on the entire palmar surface of the glove 12, including the palmar surfaces of the thumb segment 20 and any existing finger segments 22, 24, 26 and 28. Preferably, the high friction surface is formed from a PVC material 205, a nitrile material, a latex material, or a rubber material. The surface may include a plurality of depressions or a plurality of projections pattern formed from the high friction material. Formed on the illustrated material is a plurality of square-like depressions 32 that are applied to the entire palmar surface area by any standard means, as aforementioned. These square-like depressions preferably are spaced apart to allow for added grip and flexibility. The Cabretta leather palmar portion can then be conjoined to the dorsal portion, thus creating the glove. Preferably, the depths of the embodiment's depressions are such that the gap formed by the depressions allow for some movement of the palmar surfaces thereby increasing the grip capabilities of the user. The depth can generally begin at about one hundred micrometers to several millimeters or more. For example, these depressions are about two hundred micrometers or so in depth on average, about two millimeters in width and four millimeters in length.

The grip enhancing means preferably provides an effective coefficient of friction, preferably of a Shore A Durometer of about 1.0 or greater; more preferably between a coefficient of friction of between 1.5 and 4.5.

The Grip Enhancing Means may also comprise of tackified leathers or tackifiers 200 known in the art, such as tackifier rosins and their derivatives, terpenes, aliphatic, cycloaliphatic, and any of a variety of hydrocarbon-type coatings, and tackified materials including tackified leathers and synthetic leathers, and other tackifier substances known in the art. These tackifiers will provide very high grip capabilities along the glove body, significantly higher than the surrounding material forming the glove, preferably of a Shore A Durometer Coefficient of Friction of between 1.5 and 4.5, the legal limit established in several major sports such as the NATIONAL FOOTBALL LEAGUE (NFL).

Tackifiers commonly known include X40 C-TACK Revolution manufactured by CUTTERS, CARBON manufactured by NIKE, and F3 manufactured by UA, for example.

In the illustrated embodiment, the grip enhancing means comprises a tackified material 201, forming essentially the palmar portion 20 of the thumb stall 13. The square-like depressions 209 may then be formed or pressed into the palmar portion or may be left with a smooth palmar surface.

In many embodiments the grip enhancing means comprising a tackifier 200 may comprise of a grip enhancing panel 206 that is affixed to strategic locations of the glove body. For example, said grip enhancing panel may be formed of a tackified material 200, such as tackifying a leather with a tackifier, such as POWR TAC by Grand Enterprises West for example, directly onto portions of the glove body or onto a panel—make sure this is somewhere in specification for example. The tackified panel formed of any tackified material or tackifiers aforementioned, may then be bonded to, and become a part of the palmar surface of the glove by any standard method such as, for example, cementing or hot melt gluing, or sewing, or the like. Any standard method may be used in creating a tackified portion on the glove body. Such as, for example, a grip enhancing panel may be formed by resin-impregnating tackified coatings onto leathers or synthetic leathers, for example.

These tackifiers will provide very high grip capabilities along the glove body, significantly higher than the surrounding material forming the glove, preferably of a Shore A Durometer Coefficient of Friction of between 1.5 and 4.5; even more preferably, a Shore A Durometer Coefficient of Friction of between about 2.5 and 4.5, the legal limit established in several major sports such as the NATIONAL FOOTBALL LEAGUE.

The grip enhancing panel may be is attached to the glove area beginning at the digital creases and extending to overlay the forefinger metacarpophalangeal joint, the middle finger metacarpophalangeal joint, the ring finger metacarpophalangeal joint, and the pinkie finger metacarpophalangeal joint, 207. The panel portion overlaying the pinkie finger metacarpophalangeal preferably does not extend over the upper-palmar crease, however, to provide optimal flexibility. The grip enhancing panel further does not extend beyond the user's metacarpophalangeal joints and is therefore adapted not to overlay essentially any of the user's metacarpals when the glove is worn.

Square-like depressions 208 may also be formed or pressed onto the panel or may be left with smooth panel surface.

As discussed, the Grip Enhancing Means may be integral to the glove or may be affixed to the glove using any standard methods. For example, the construction of the palmar portion of the glove body thumb stall may preferably use a tackified leather by embedding a leather with a tackifier by any standard method, for example, and then attaching said palmar portion to the rest of the palmar glove body by any standard methods, such as by sewing.

It is commonly known that wrist bands have been constructed with perspiration absorbing capabilities, allowing an athlete to wipe perspiration away from their face during competition. Where wrist bands are not commonly used, such as in golf or football play, the athlete is currently left deficient in this area. As such, a moisture absorbent material 39 may be provided along the dorsal portion of embodiments allowing a user to wipe off perspiration commonly on a user's face during active sports play. The moisture absorbent material is thereby adapted to absorb perspiration when coming in contact with the user's face, when the glove is worn. The moisture absorbent material may be secured anywhere along the dorsal surface of the glove body, such as along the glove material overlaying the metacarpal of the user's forefinger 203. The moisture absorbent material may be formed of any moisture absorbent material aforementioned, such as, for example, about 1/12 inch or so of terry cloth 39 or absorbent foam stitched onto the dorsal surface of the glove body.

The dorsal surface may comprise of a different material than the palmar surface, such as a more durable fabric, but would preferably also be rather flexible. If the dorsal surface is comprised of more durable fabrics, such as synthetic leather, for example, then some added elasticity capabilities may be also preferable on select areas of the dorsal surface, in particular around the metacarpophalangeal joints. For example, the dorsal surface may comprise of an aperture on the forefinger's metacarpophalangeal joint, the middle finger's metacarpophalangeal joint, the ring finger's metacarpophalangeal joint, and on the pinkie finger's metacarpophalangeal joint. Alternatively, embodiments may simply comprise of a more elastic material, such as any of those aforementioned such as spandex, on the dorsal surface overlaying said metacarpophalangeal joints, or seams or slits, while the rest of the dorsal surface is comprised of a more durable material. The elastic material could be stitched onto those areas, and therefore replacing the more durable materials along those select areas.

The palmar and dorsal surfaces, and any wrist portions, may then be conjoined on any finger and thumb portions, dorsal and palm portions and a wrist portion using any standard methods, such as by stitching, thus defining a pocket for receiving a user's hand. Construction of the embodiment can be formed of any standard glove forming materials or of any materials aforementioned.

As aforementioned, this embodiment provides users with several benefits, in multiple sports. For example, those playing the sport of Golf may use this embodiment on their weak hand thereby allowing the golfer significantly more grip capabilities while simultaneously being able to have heightened tactile abilities at the same time on key areas of the interlocked—and partially uncovered—forefinger.

By way of example, baseball pitchers may also find this embodiment beneficial over their strong (pitching) hand primarily because it offers grip enhancing capabilities on the fingertips on select digital segments while allowing the pitcher to maintain heightened feel by simultaneously providing the pitcher with the ability to touch the baseball with the skin of his or her forefinger.

Figure 5:
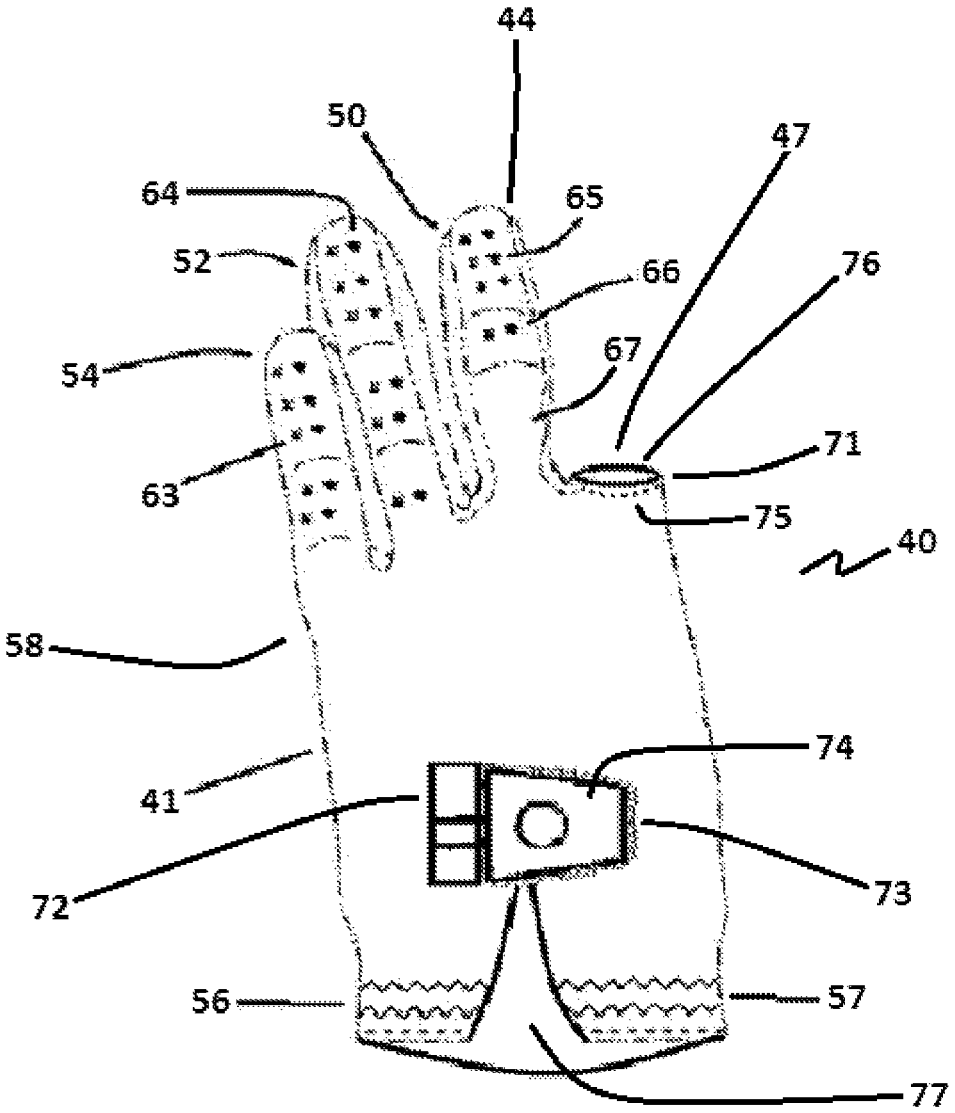
FIG. 5 is a drawing of the embodiment as described in FIG. 3, showing the dorsal view.
Figure 13:
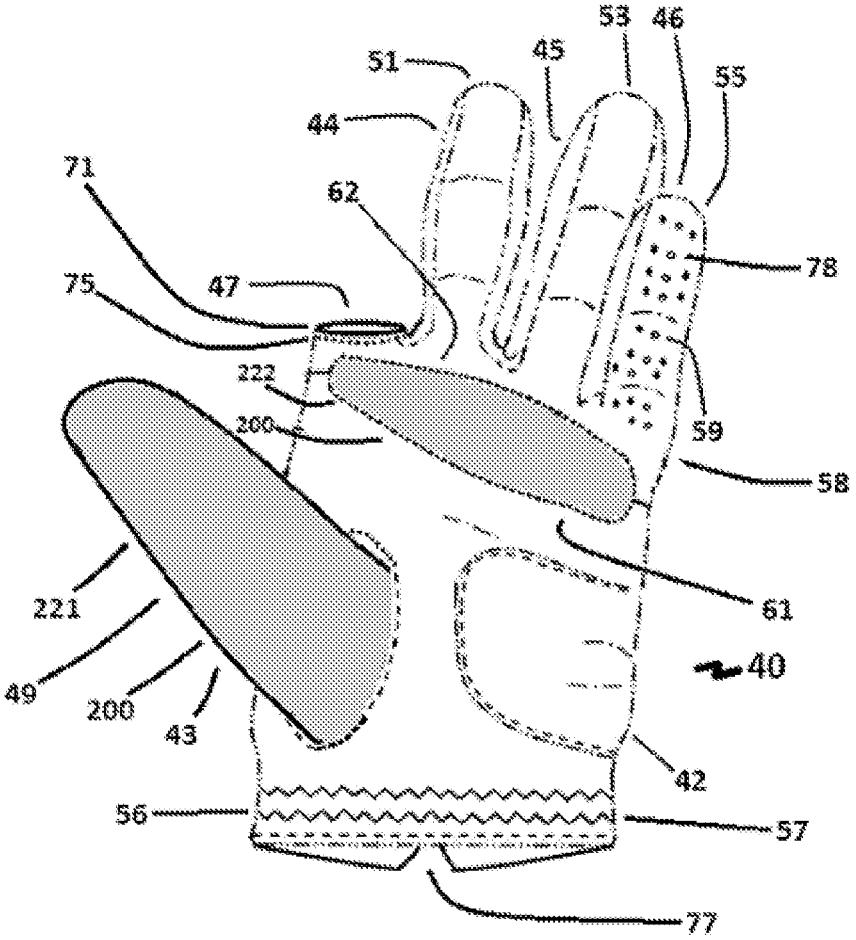
FIG. 13 is a drawing improving the palmar view of FIG. 3.
Figure 14:
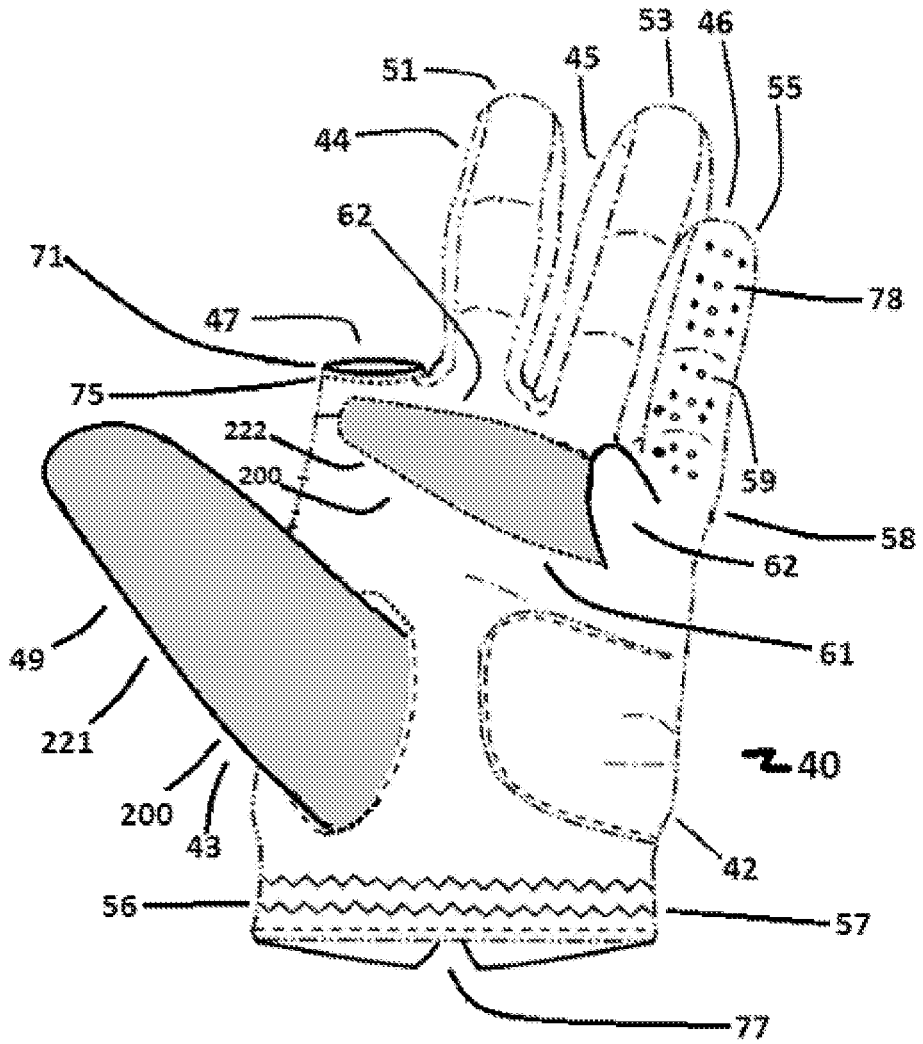
FIG. 14 shows the top and bottom view of a panel which creates a higher friction surface on an embodiment, as shown in FIG. 3.
Figure 15:
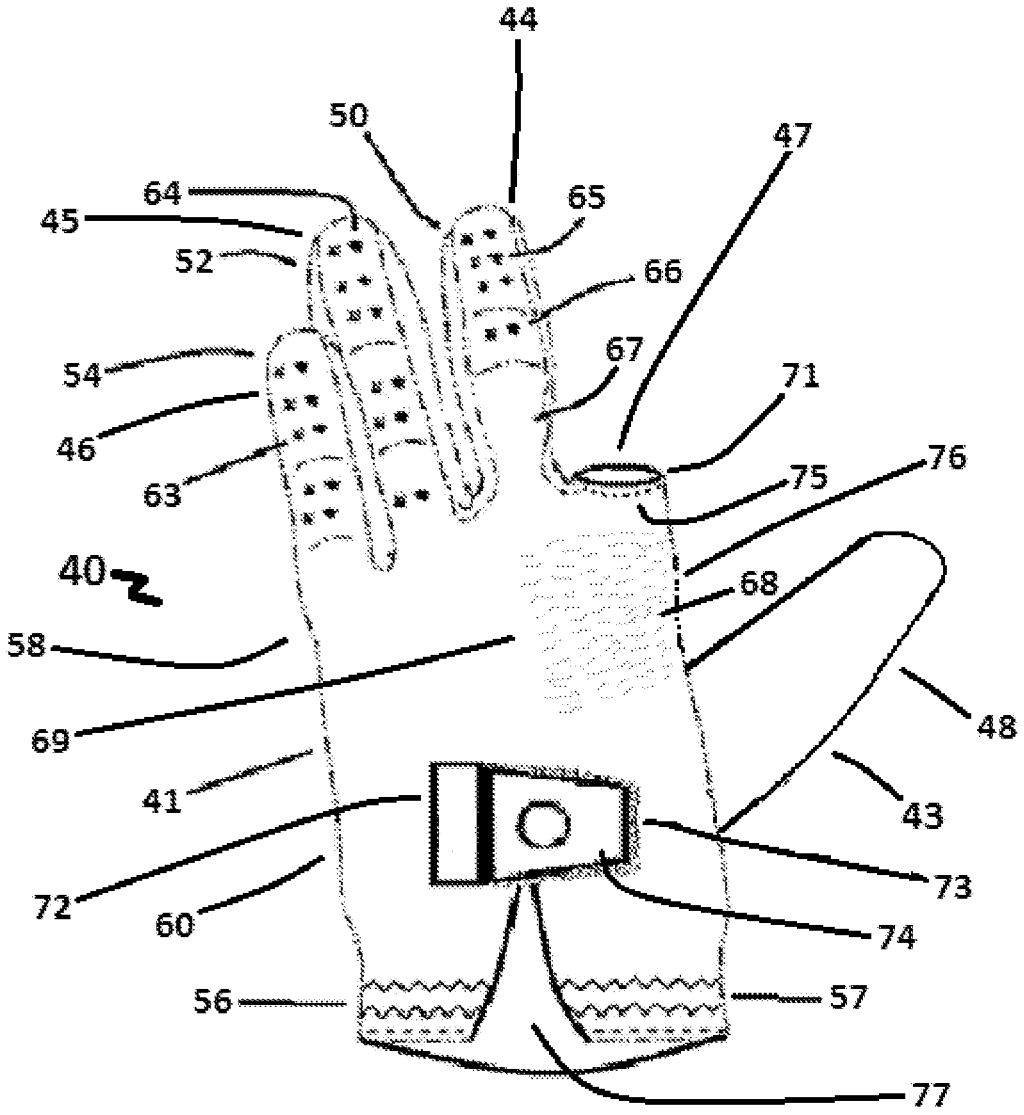
FIG. 15 is a drawing improving the dorsal view of FIG. 5.

Referring now to a second embodiment of the athletic glove of the present invention is shown and designated as 40. This embodiment comprises a glove with a body comprising a palmar portion, a dorsal portion and a distal lateral edge, wherein the palmar portion and the dorsal portion meet at the distal lateral edge. The glove also comprises a plurality of digital segments projecting from the distal lateral edge of the body, the plurality of digital segments including a digital segment that is adapted to cover and enclose an entire thumb finger, a digital segment that is adapted to cover and enclose an entire middle finger, and a digital segment is adapted to cover and enclose an entire ring finger when the glove is worn. The glove also comprises a terminal edge 71 at the distal lateral edge of the body designed to allow a forefinger to extend past the terminal edge to completely expose the forefinger when the glove is worn, thereby providing a glove without a digital segment for a forefinger. The palmar (front) view of the glove is drawn in FIG. 3 and the dorsal (back) view of the same glove is drawn in FIG. 5. Newer continuation in part improvements 200, 221, 222 of the second embodiment are shown on FIGS. 13, 14, & 15. This partial-fingered embodiment provides a glove having a dorsal portion 41 and a palmar portion 42 for overlaying respective back and palm regions of a human hand, said dorsal and palmar portions having distal and proximal ends with a plurality of digital segments (or stalls) projecting from said distal ends. The glove includes a glove body having a back portion covering the dorsal surface of the hand 41, and a front portion covering essentially the entire palm surface of the hand 42. The glove body includes finger segments and a thumb segment each adapted to receive a finger or thumb, respectively, therein.

In the illustrated embodiment, the glove is constructed such that the thumb 43 digital segment encloses said thumb, including enclosing the fingertips. The glove also has a middle finger digital segment 44 that covers the middle finger, including the fingertips, a ring finger digital segment 45 that covers the ring finger, including the fingertips, and a pinkie finger digital segment 46 that covers the pinkie finger, including the fingertips of a user. This embodiment does not have a forefinger digital segment 47 therefore a user's forefinger is completely uncovered when the glove is worn. In other words, the user's forefinger, defined by the proximal phalanx, the middle phalanx and the distal phalanx of the user's forefinger, is entirely exposed when the glove is worn.

The palmar surface of this glove embodiment therefore essentially covers the rest of the front of the hand, including the entire palm of the hand as well as all of the five metacarpals of all user's hand including the entire metacarpal of the user's forefinger 42; the dorsal section covers most of the rest of the back of the hand 41.

The thumb stall 43 is defined by a dorsal portion 48 and palmar portion 49. The middle finger stall 44 is defined by a dorsal portion 50 and a palmar portion 51. The ring finger stall 45 is defined by a dorsal portion 52 and a palmar portion 53. The pinkie finger stall 46 is defined by a dorsal portion 54 and a palmar portion 55. There is no forefinger stall so there is no dorsal or palmar portion defining the forefinger stall.

The glove also has an expandable opening means at a wrist end portion 56 adapted to receive the user's hand. The expandable opening means comprises an elastic material such as an elastomeric band 57 fixed around the wrist to expand and contract when the glove is worn.

The glove dorsal portion further comprises a strap means 72 at the open end of the glove body dorsal portion for fastening the glove body secure about the wrist area, critical in sports activities where the user's hand moves very rapidly such as in golf or football. The strap means may have two pads of cohesive-adhesive material 73, 74 for releasably securing the strap. The strap as well as this wrist portion may be sewn onto the glove, for example.

The dorsal portion of the glove further comprises a slit 77. The slit allows the user to quickly take off or put on the glove, and doing so very easily. These features of providing a slit with a strap means are especially valuable to users who play a sport that requires the constant removal of the glove, such as in football—where players generally take off their gloves during a change of possession, and in golf—where virtually all players take off their glove when preparing to putt a golf ball.

This embodiment further provides unique and critical features on and around the terminal edge 71 at the distal lateral edge of the body designed to allow a forefinger to extend past the terminal edge to completely expose the user's forefinger when the glove is worn. Specifically, for example, the terminal edge is reinforced by stitching 75. Sewing along or around the ringlet opening 71 by stitching is particularly important because the opening would otherwise easily tear, destroying the distal edge making the glove inoperable. Therefore the stitching is adapted to encircle the terminal edge in order to be effective at preventing tearing.

This embodiment further shows how the present invention may also comprise a grip enhancing means 78, 200. Although the embodiment now provides a higher coefficient of friction on a golfer's weak hand, one may now further increase grip areas by adding a grip enhancing means on select areas.

The pinkie finger digital segment 46 of this embodiment has a grip enhancing means 78 consisting of a plurality of projections 59 in the form of PVC dots 59, on at least a portion of the palmar pinkie finger segment. The PVC dots preferably project out about seven hundred micrometers or so. The PVC dots located on the palmar section of the pinkie finger stall are throughout said stall. Similar embodiments may have a grip enhancing means also along the thumb segment, to maximize grip abilities on the fingertips of the thumb and pinkie finger. This will allow for greater golf club grip retention throughout the golf swing including during impact with the golf ball.

The embodiment is adapted such that the palmar portion of the middle finger stall and ring finger stall are both free of said grip enhancing means, such as the plurality of projections for example.

The grip enhancing means of the present invention may be integral to the glove or may be affixed to the glove using any standard methods. For example, this embodiment comprises grip enhancing means that is integral to the glove pinkie finger stall, using any standard method known in the art. For example, the PVC dots can be imparted by any standard methods, such as, for example, by molding. The heights of the PVC dots in this embodiment are all about the same height, and are in rows. Other embodiments could of course offer different heights, non-uniform heights, and have a more random pattern on the top surface.

The locations of the grip enhancing means may vary on several factors of course, such as personal preference and preferred degree of enhanced grip. This added grip configuration will be useful especially to golfers and baseball pitchers for reasons described herein.

The embodiment's grip enhancing means 78 can also comprise of a high friction surface, such as creating criss-cross depressions, to the glove area beginning at the digital creases and extending to overlay the forefinger metacarpophalangeal joint, the middle finger metacarpophalangeal joint, the ring finger metacarpophalangeal joint, and the pinkie finger metacarpophalangeal joint. The grip enhancing means portion overlaying the pinkie finger metacarpophalangeal joint may preferably not extend over the upper-palmar crease, however, to provide optimal flexibility.

The Grip Enhancing Means may also comprise of tackified leathers or tackifiers 200 known in the art, such as tackifier rosins and their derivatives, terpenes, aliphatic, cycloaliphatic, and any of a variety of hydrocarbon-type coatings, and tackified materials including tackified leathers and synthetic leathers, and other tackifier substances known in the art. These tackifiers will provide very high grip capabilities along the glove body, significantly higher than the surrounding material forming the glove, preferably of a Shore A Durometer Coefficient of Friction of between about 1.5 and 4.5, the legal limit established in several major sports such as the NATIONAL FOOTBALL LEAGUE (NFL).

Tackifiers commonly known include X40 C-TACK Revolution manufactured by CUTTERS, CARBON manufactured by NIKE, and F3 manufactured by UA, for example.

In the illustrated embodiment, the grip enhancing means 200 comprises a tackified material 221 forming essentially the palmar portion 49 of the thumb stall 43.

As discussed, the Grip Enhancing Means may be integral to the glove or may be affixed to the glove using any standard methods. For example, the palmar portion of the glove body thumb stall may be constructed using a tackified leather by embedding a leather with a tackifier chemical compound by any standard method, for example, and then attaching said palmar portion to the rest of the glove by any standard methods, such as by stitching, and is configured to provide a much higher coefficient of friction than the surrounding untackified material forming the glove.

In many embodiments the grip enhancing means comprising a tackifier 200 may comprise of a grip enhancing panel 222 that is affixed to strategic locations of the glove body. For example, said grip enhancing panel may be formed of a tackified material 200, such as impregnating a leather with a tackifier, for example, or other tackifier substances known in the art. The tackified panel formed of any tackified material or tackifiers aforementioned may then be bonded to, and become a part of the palmar surface of the glove by any standard method such as, for example, cementing or hot melt gluing, or sewing, or the like. Any standard method may be used in creating a tackified portion on the glove body.

These tackifiers will provide very high grip capabilities along the glove body, significantly higher than the surrounding material forming the glove, preferably of a Shore A Durometer Coefficient of Friction of between 1.5 and 4.5; even more preferably, a Shore A Durometer Coefficient of Friction of between about 2.5 and 4.5, the legal limit established in several major sports such as the NATIONAL FOOTBALL LEAGUE.

The grip enhancing panel may be is attached to the glove area beginning at the digital creases and extending to overlay the forefinger metacarpophalangeal joint, the middle finger metacarpophalangeal joint, the ring finger metacarpophalangeal joint, and the pinkie finger metacarpophalangeal joint, 61. The panel portion overlaying the pinkie finger metacarpophalangeal preferably does not extend over the upper-palmar crease, however, to provide optimal flexibility. The grip enhancing panel further does not extend beyond the user's metacarpophalangeal joints and is therefore adapted not to overlay essentially any of the user's metacarpals when the glove is worn.

Figure 10:
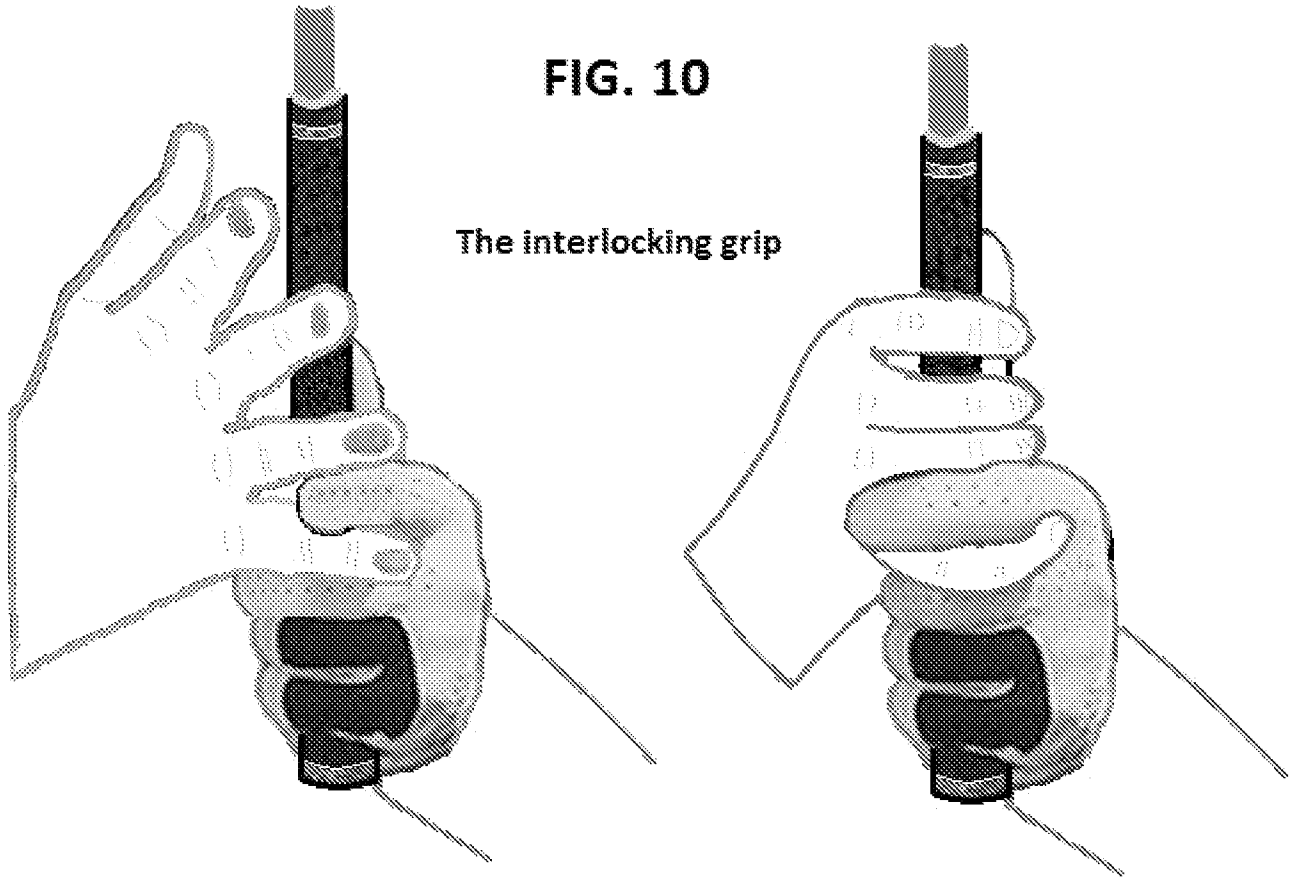
FIG. 10 shows a typical interlocking grip using a conventional prior art glove.

A plurality of micro recesses of about 0.120 millimeters in diameter may be randomly disposed about the front, back and finger and thumb stalls of the glove, thereby providing added comfort and more ventilation. The illustrated embodiment has micro recesses along and throughout the pinkie finger segment 63 and ring finger segment 64. Additionally, there are micro recesses along only the distal 65 and middle phalanges 66 of the middle finger segment. There are no micro recesses along the proximal phalanx 67 of the middle finger. When a user of this embodiment grips a golf club using the interlocking grip, the strong hand's pinkie finger interlocks with the completely uncovered forefinger thereby providing heightened tactile sensitivities throughout the interlocked fingers. However, as can be seen in FIG. 10, the strong hand's pinkie finger also comes into contact with the weak hand's middle finger segment—specifically with the middle finger's proximal phalanx.

It is commonly known that wrist bands have been constructed with perspiration absorbing capabilities, allowing an athlete to wipe perspiration away from their face during competition. Where wrist bands are not commonly used, such as in golf or football play, the athlete is currently left deficient in this area. As such, a moisture absorbent material 76 may be provided along the dorsal portion of embodiments allowing a user to wipe off perspiration commonly on a user's face during active sports play. The moisture absorbent material is thereby adapted to absorb perspiration when coming in contact with the user's face, when the glove is worn.

The moisture absorbent material may be secured anywhere along the dorsal surface of the glove body, such as along the glove material overlaying the metacarpals of the user's forefinger 68 and middle finger 69. The moisture absorbent material may be formed of any moisture absorbent material aforementioned, such as, for example, about 1/12 inch or so of terry cloth 76 or absorbent foam stitched onto the dorsal surface of the glove body.

This embodiment may be constructed of any standard material known in the art or aforementioned, such as comprising of essentially the same materials to construct both the palmar and dorsal surface. For example, the glove 41, 42 can be made primarily of a genuine leather such as Cabretta leather or of a synthetic yarn and cotton blend for superior comfort, say about seventy percent synthetic. Examples of other synthetic yarns include polyester, nylon, spandex (polyurethane) yarns, LYCRA, and synthetic leather.

Additionally, embodiments such as this one, may be completely coated with a with a water repellant substance 60, such as a synthetic resin 60 on the palmar surface or throughout the entire glove.

The benefits of this configuration allows a user to have maximum retention of tactile sensation along the weak hand's forefinger, allowing the skin of said forefinger to touch not only the dominant hand's pinkie finger, but also the actual golf club, along the forefinger's uncovered proximal phalanx. The uncovered forefinger portion allows the user to maximize hand coordination, for example, crucial in completing a successful golf swing. This unique offering will significantly increase a user's ability to control a golf club and also therefore a golf swing and golf ball.

Figure 3:
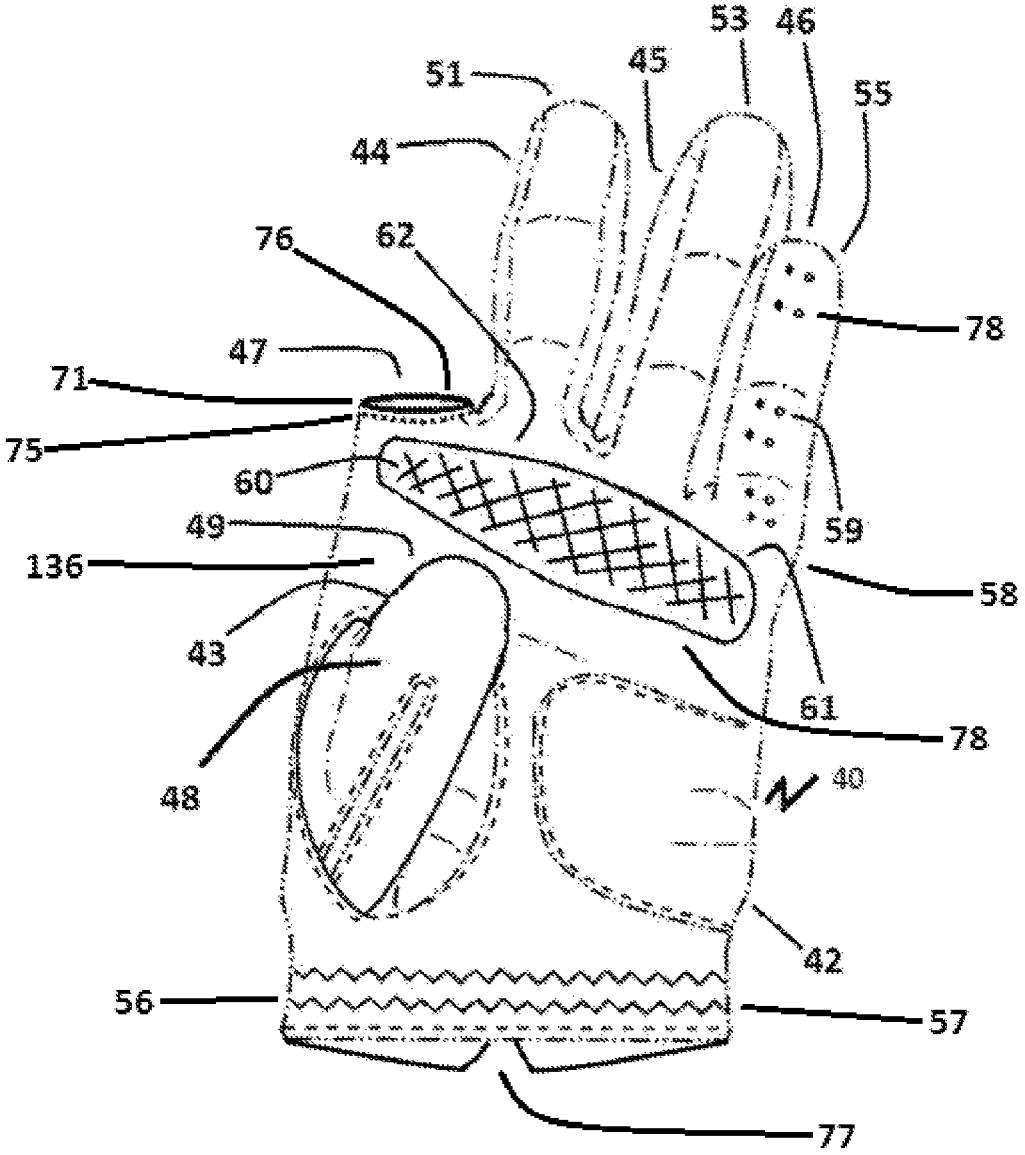
FIG. 3 is a drawing of the palmar view of a second embodiment.
Figure 4:
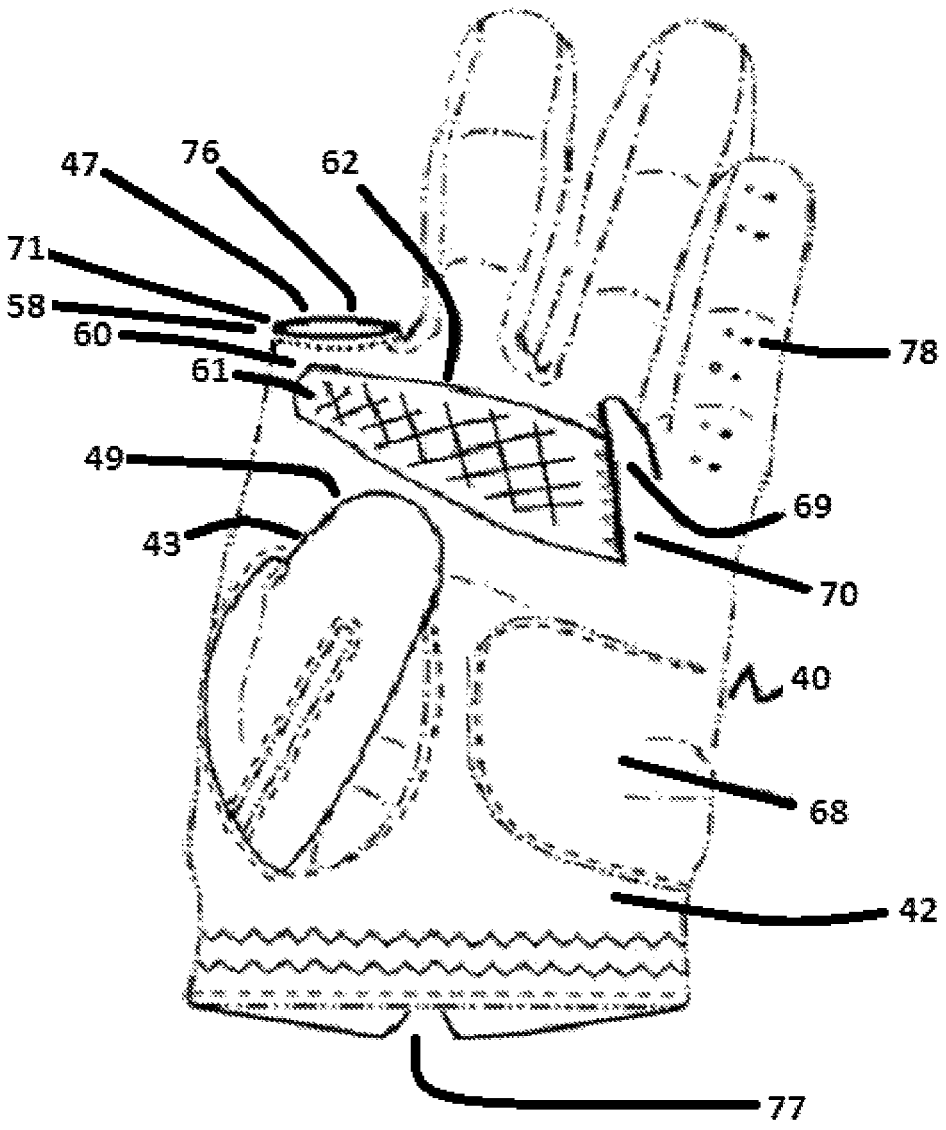
FIG. 4 shows the top and bottom view of a panel which creates a higher friction surface on an embodiment, as shown in FIG. 3.

Referring now specifically to FIG. 4, what is shown is the top (front) and bottom (back) portions of a panel which creates a higher friction surface on an embodiment, as shown in FIG. 3. Specifically, shown is a panel overlaying much of the metacarpophalangeal joints of the forefinger, middle finger, ring finger, and pinkie finger stalls 61.

In general, as aforementioned, a grip enhancing means may be either formed on or applied to any palmar portion, such as the palm or any thumb or any existing finger stalls, using any standard methods.

This embodiment shows a grip enhancing means comprising a grip enhancing panel formed by a tackified material, for example, then attaching said panel onto a portion of the gloves palmar surface area. The bottom portion of the panel 62 is attached to the palmar surface of the glove by any standard methods of attachment, such as by an adhesive 62 or stitching, or both, for example.

Figure 6:
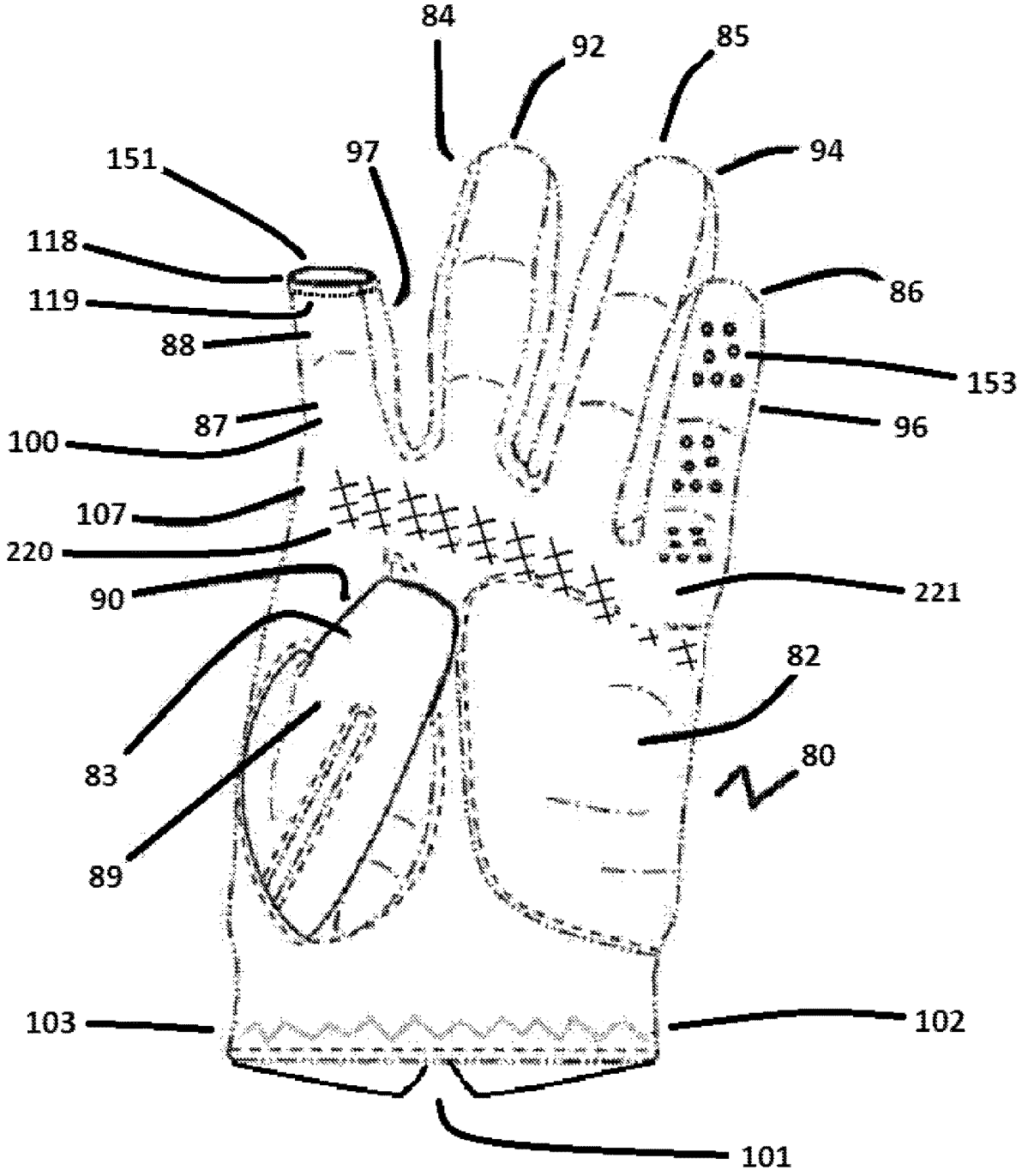
FIG. 6 is a drawing of the palmar view of a third embodiment, shown as a partial-fingered glove. The glove has a forefinger segment that covers the forefinger's proximal and middle phalanges but does not extend to cover the forefinger's distal phalanx.
Figure 7:
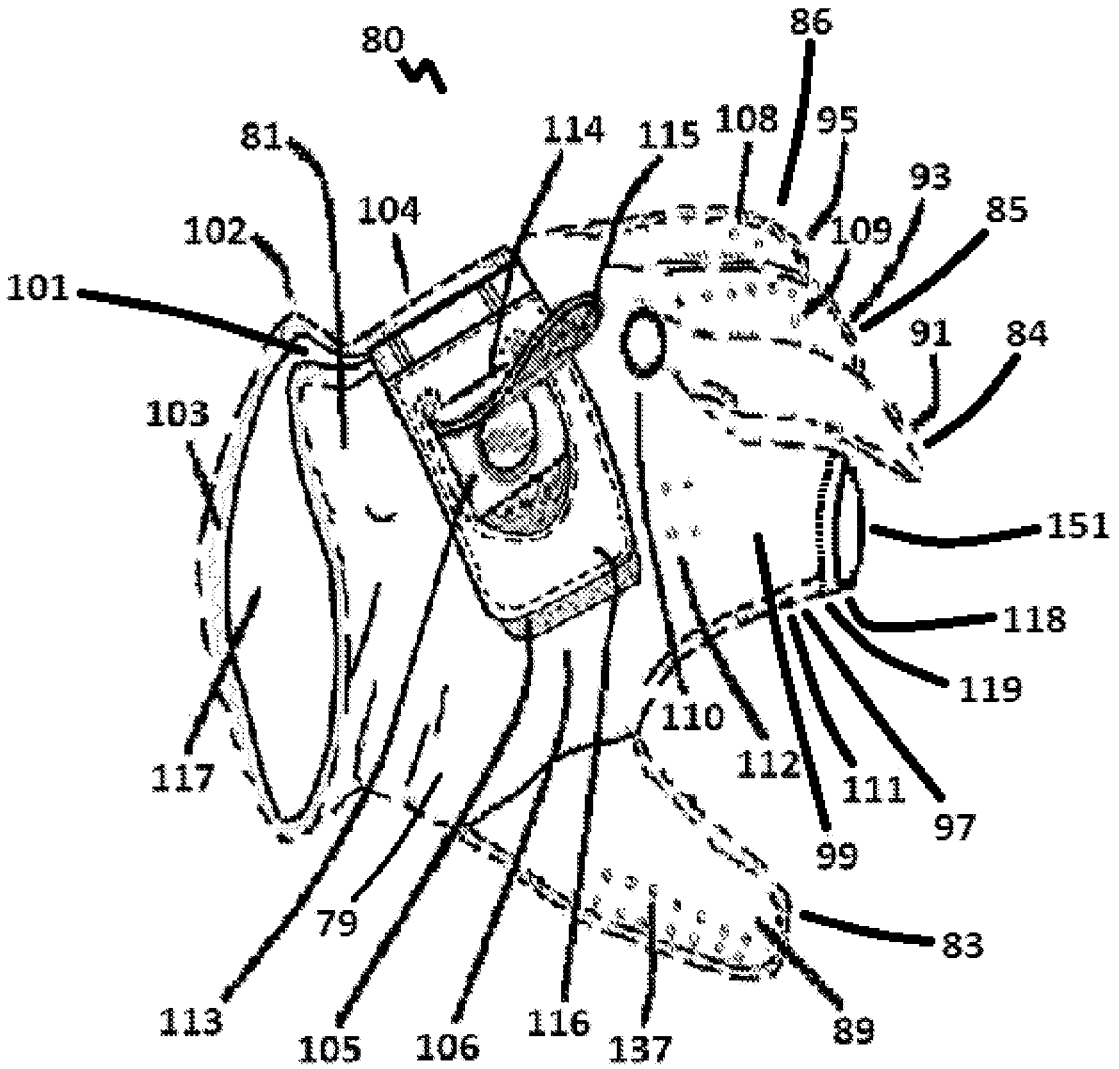
FIG. 7 is a drawing of the embodiment as described in FIG. 6, dorsal view.
Figure 16:
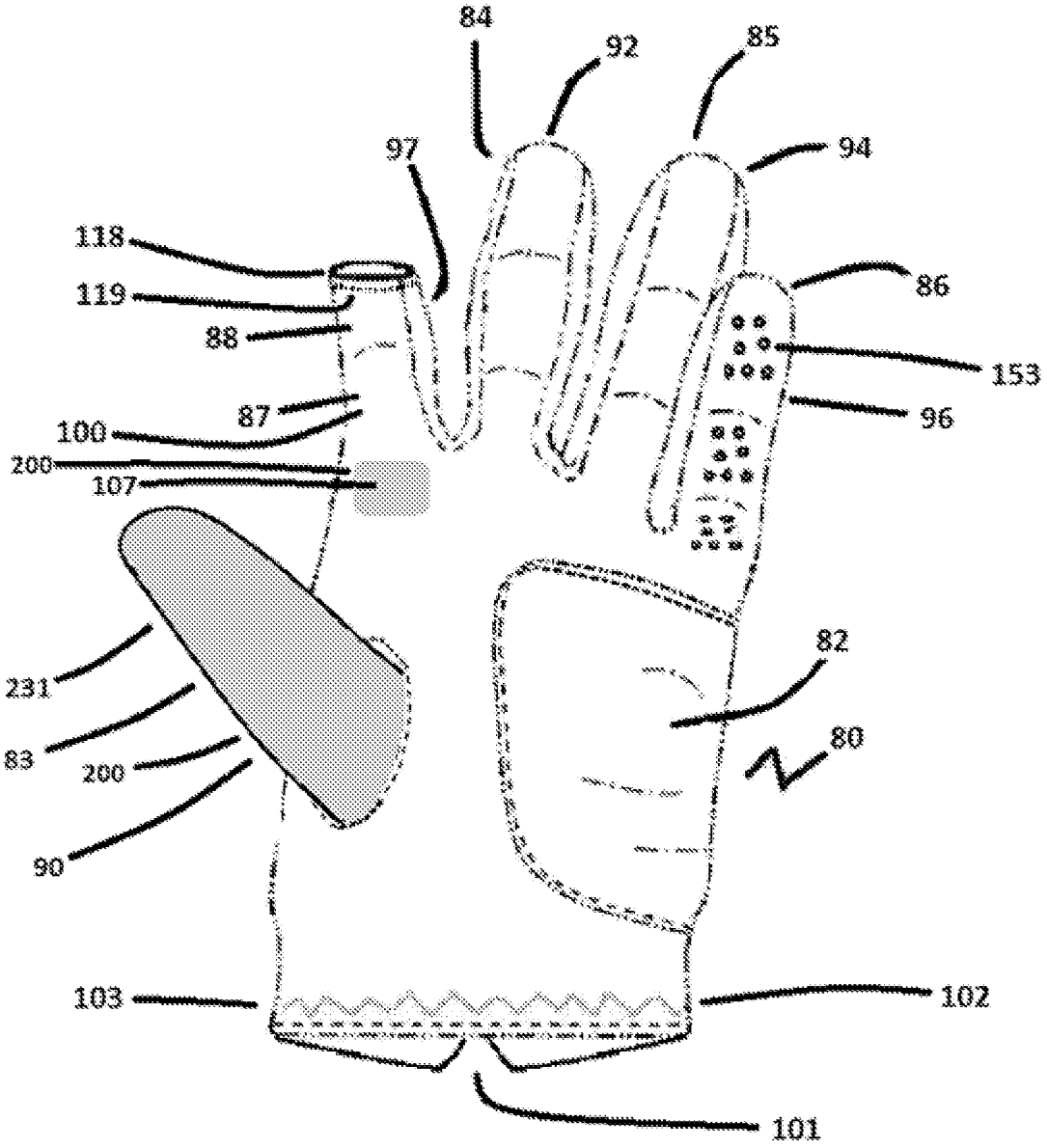
FIG. 16 is a drawing improving the palmar view of FIG. 6.
Figure 17:
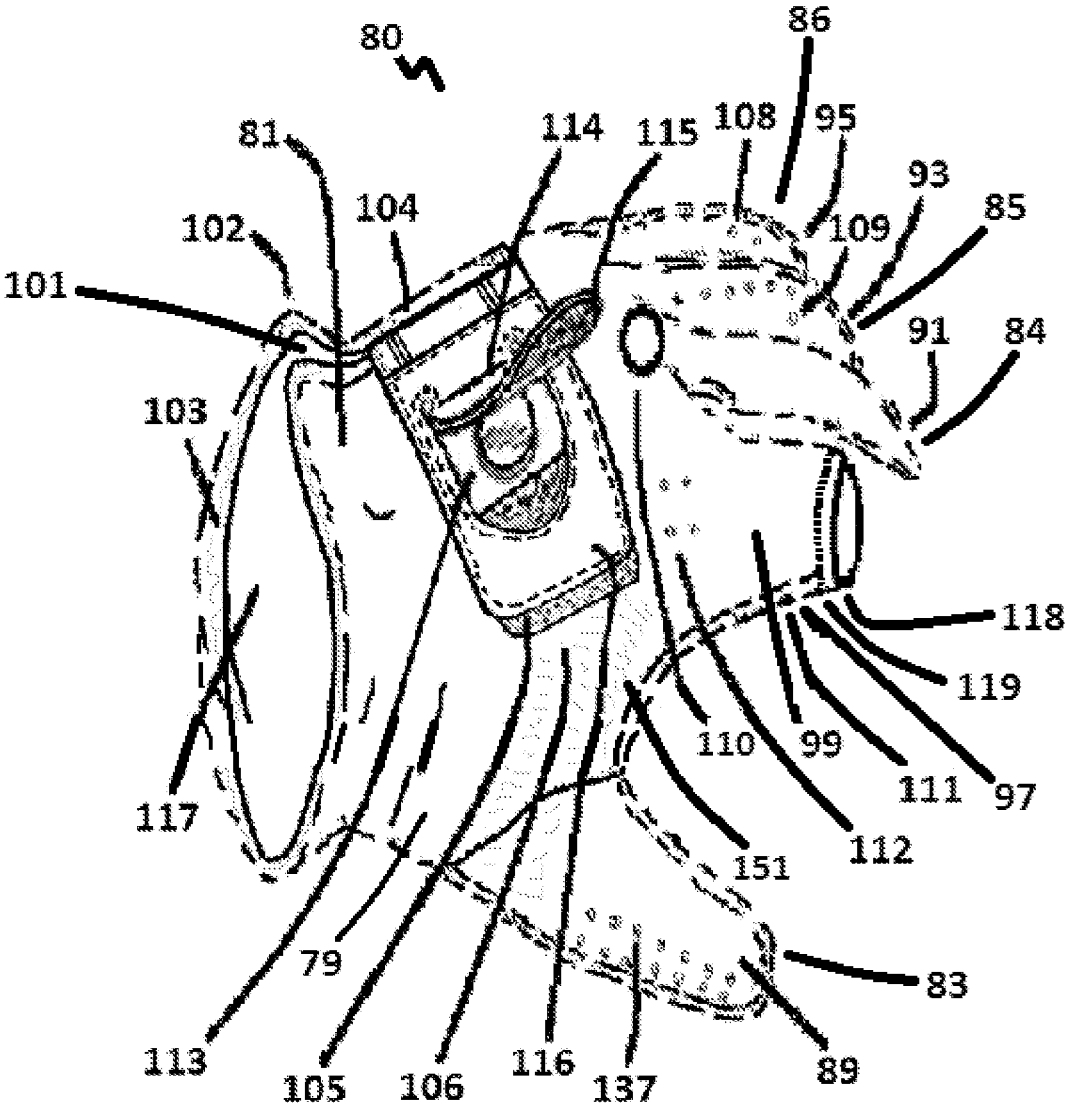
FIG. 17 is a drawing improving of the dorsal view of FIG. 7.

Referring now to a third embodiment of an athletic glove of the present invention is shown and designated as 80 in FIG. 6 and FIG. 7. Continuation in part improvements are shown and designated in FIG. 16 and FIG. 17. This embodiment comprises a glove with a body comprising a palmar portion, a dorsal portion and a distal lateral edge, wherein the palmar portion and the dorsal portion meet at the distal lateral edge. The glove also comprises a plurality of digital segments projecting from the distal lateral edge of the body, the plurality of digital segments including a digital segment that is adapted to cover and enclose an entire thumb finger, a digital segment that is adapted to cover and enclose an entire middle finger, a digital segment that is adapted to cover and enclose an entire ring finger, and a digital segment that is adapted to cover and enclose an entire pinkie finger when the glove is worn. The glove also comprises a partial forefinger digital segment 97 with a distal terminal edge 118 that is adapted to cover the entire proximal phalanx of the user's forefinger while exposing the entire distal phalanx of the user's forefinger when the glove is worn, thereby allowing heightened tactile sensitivities along the fingertip and simultaneously enhancing grip capabilities along the covered proximal phalanx of the user's forefinger.

The palmar (front) view of a glove embodiment is drawn in FIG. 6 and the dorsal (back) view of the same glove is drawn in FIG. 7. Newer continuation in part improvements 200, 221, 231 of the third embodiment are shown on FIGS. 16 & 17. This partial-fingered embodiment provides a glove having a dorsal portion 81, a palmar portion 82 for overlaying respective back and palm regions of a human hand, said dorsal and palmar portions having distal and proximal ends with a plurality of digital segments (or stalls) projecting from said distal ends. The glove includes a glove body having a back portion covering the back of the hand 81, and a front portion covering the palm or front of the hand 82. The glove body includes finger stalls and a thumb stall each adapted to receive a finger or thumb, respectively, therein.

In the illustrated embodiment, the glove is constructed such that the thumb segment 83, middle finger segment 84, ring finger segment 85 and pinkie digital segment 86 enclose the thumb, middle finger, ring finger, and pinkie fingers including enclosing the fingertips, respectively, of the user's hand when the glove is worn. The glove also has a forefinger segment that covers the forefinger's proximal 87 and middle phalanges 88 but does not extend to cover the forefinger's distal phalanx; the fingertip of the user's forefinger is therefore exposed when the glove is worn. The palmar section covers the palm of the hand 82 and the dorsal section covers the back of the hand 81. The glove also has a wrist portion that surrounds the wrist of a user.

The thumb stall 83 is defined by a dorsal portion 89 and a palmar portion 90. The middle finger stall 84 is defined by a dorsal portion 91 and a palmar portion 92. The ring finger stall 85 is defined by a dorsal portion 93 and a palmar portion 94. The pinkie finger stall 86 is defined by a dorsal portion 95 and a palmar portion 96. The forefinger stall 97 is defined by a dorsal portion 99 and a palmar portion 100.

The wrist portion is preferably expansible so as to hold more securely to the user's wrist. Therefore the embodiment also has an expandable opening means at a wrist end comprising an elastic material along the wrist portion 102, such as an elastomeric band 103 fixed around throughout the wrist portion. In addition, the glove further comprises a strap means 104 at the open end of the glove body dorsal portion for fastening the glove body secure about the wrist area, critical in sports activities where the user's hand moves very rapidly such as in golf or football. The strap means may be unitary with the glove body and may include VELCRO fasteners 105, 106, buttons, and the like or other suitable closures thereon. The strap means allows the user to ensure a tight fit around the user's hand so that it will not disengage from the user's hand during high velocity sport movements such as swinging a driving wood golf club or throwing a Hail Mary football pass. The strap means also allows the user to quickly engage and disengage the glove, important aspects during active sports play such as in golf and in football. The wrist portion further comprises a slit 101. The slit allows the user to quickly take off or put on the glove, and doing so very easily.

Providing a slit and strap means is especially valuable to users who play a sport that requires the constant removal of the glove, such as in football—where players generally take off their gloves during a change of possession, and golf—where virtually all players take off their glove when preparing to putt a golf ball. The strap means is adapted to allow the user to mechanically stretch the strap means across the slit and fasten the glove to the user's hand.

This embodiment further provides unique features on and around the distal terminal edge 118 of the partial forefinger digital segment that is adapted to expose the distal phalanx of the user's forefinger when the glove is worn. Specifically, for example, the distal terminal edge is reinforced by stitching 119. Stitching the forefinger stall along or around the opening prevents the distal terminal edge from tearing, destroying the finger segment making the glove inoperable. Therefore the stitching is adapted to encircle the distal terminal edge of the forefinger digital segment in order to prevent tearing.

This embodiment further shows how the present invention may comprise a grip enhancing means 107, 153, 200. Although the glove now provides a higher coefficient of friction on a golfer's weak hand, for example, one may now further increase grip capabilities by adding a grip enhancing means along select portions of the palmar surface of the glove.

Having a gripping enhancing means along these areas will significantly increase a user's ability to control an object such as a golf club by creating an even higher coefficient of friction.

Embodiments may further comprise a grip enhancing means 153 consisting of a plurality of projections 153 in the form of PVC dots 153, on the palmar pinkie finger segment 96. The PVC dots preferably project out about seven hundred micrometers or so. The PVC dots located on the palmar section of the pinkie finger stall are throughout said stall to maximize grip abilities particularly on the pinkie finger. This will allow for greater golf club grip retention throughout the golf swing including during impact with the golf ball.

The Grip Enhancing Means may also comprise of tackified leathers or tackifiers 200 known in the art, such as tackifier rosins and their derivatives, terpenes, aliphatic, cycloaliphatic, and any of a variety of hydrocarbon-type coatings, and tackified materials including tackified leathers and synthetic leathers, and other tackifier substances known in the art. These tackifiers will provide very high grip capabilities along the glove body, significantly higher than the surrounding material forming the glove, preferably of a Shore A Durometer Coefficient of Friction of between about 1.5 and 4.5, the legal limit established in several major sports such as the NATIONAL FOOTBALL LEAGUE (NFL).

Tackifiers commonly known include X40 C-TACK Revolution manufactured by CUTTERS, CARBON manufactured by NIKE, and F3 manufactured by UA, for example.

In the illustrated embodiment, the grip enhancing means 200 comprises a tackified material 231 forming essentially the palmar portion 90 of the thumb stall 83.

As discussed, the Grip Enhancing Means may be integral to the glove or may be affixed to the glove using any standard methods. For example, the palmar portion of the glove body thumb stall may be constructed using a tackified leather by embedding a leather with a tackifier by any standard method, for example, and then attaching said palmar portion to the rest of the glove by any standard methods, such as by stitching or bonding, and is configured to provide a much higher coefficient of friction than the surrounding untackified material forming the glove.

In many embodiments the grip enhancing means comprising a tackifier 200 may comprise of a grip enhancing panel 107 that is affixed to strategic locations of the glove body. For example, said grip enhancing panel may be formed of a tackified material 200, such as impregnating a leather with a tackifier, for example, or other tackifier substances known in the art. The tackified panel formed of any tackified material or tackifiers aforementioned may then be bonded to, and become a part of the palmar surface of the glove by any standard method such as, for example, cementing or hot melt gluing, or sewing, or the like. Any standard method may be used in creating a tackified portion on the glove body.

The grip enhancing panel may be is attached to the glove area, such as over the forefinger's metacarpophalangeal joint. This grip enhancing means is discreet 107 and does not extend beyond the forefinger's metacarpophalangeal joint. Those using the interlocking grip would find this grip enhanced location especially useful when trying to maintain golf club control along the forefinger's metacarpophalangeal joint, the area just below where the weak hand's forefinger interlocks with the dominant hand's pinkie finger.

These tackifiers will provide very high grip capabilities along the glove body, significantly higher than the surrounding material forming the glove, preferably of a Shore A Durometer Coefficient of Friction of between 1.5 and 4.5; even more preferably, a Shore A Durometer Coefficient of Friction of between about 2.5 and 4.5, the legal limit established in several major sports such as the NATIONAL FOOTBALL LEAGUE.

A plurality of micro recesses of about 0.120 millimeters in diameter may be randomly disposed about the front, back and finger and thumb stalls of the glove, thereby providing added comfort and more ventilation. The illustrated embodiment provides micro-recesses throughout the thumb 137 as well as the pinkie finger 108 and ring finger digital segments 109. Additionally, no micro-recesses are provided on the embodiment's middle finger segment but may be provided along said segment's middle or distal phalanx segment, if preferred. An aperture is provided along the middle finger metacarpophalangeal joint segment 110 to allow moisture to escape the middle finger segment without disturbing the interlocked finger area. Finally, micro-recesses are provided along the forefinger digital segment in order to maintain a more moisture-free forefinger dorsal segment—where the dominant hand's pinkie finger interlocks with the weak hand's forefinger 111. Micro-recesses are provided, however, along the forefinger's metacarpophalangeal joint segment 112, which, along with the uncovered distal phalanx, will provide a more strategic moisture management system for golf glove embodiments.

Additionally, embodiments such as this one, may be coated with a with a water repellant substance 79, such as a synthetic resin 79 throughout the entire outer surface of the glove.

It is commonly known that wrist bands have been constructed with perspiration absorbing capabilities, allowing an athlete to wipe perspiration away from their face during competition. Where wrist bands are not commonly used, such as in golf or football play, the athlete is currently left deficient in this area. As such, a moisture absorbent material 151 may be provided along the dorsal portion of embodiments allowing a user to wipe off perspiration commonly on a user's face during active sports play. The moisture absorbent material is thereby adapted to absorb perspiration when coming in contact with the user's face, when the glove is worn. The moisture absorbent material may be secured anywhere along the dorsal surface of the glove body. The moisture absorbent material may be formed of any moisture absorbent material aforementioned, such as, for example, about 1/12 inch or so of terry cloth 151 or absorbent foam stitched onto the dorsal surface of the glove body.

This embodiment may also comprise a detachable ball marker 113. A ball marker is often used when playing golf. During certain times, such as when reaching the green or when obstructing another player's direct path to the golf hole, the golfer may pick his ball and place a ball marker directly behind the golf ball; the golfer can then pick up the golf ball. The embodiment provides a convenient, detachable ball marker on the glove. The detachable ball marker in this embodiment is a small circular object with a design that points to where the golf ball exactly is located.

The detachable ball marker is secured by any standard fastening means, such as by a compartment, by magnetism or snap fastening, for example. The illustrated embodiment shows a compartment 114 within the strap on the dorsal segment of the glove. The compartment secures the ball marker by VELCRO fasteners 115, 116, but other commonly known fasteners will work just as well. The ball marker may be circular or non-circular in design.

Additionally, embodiments may offer a liner is fixed to the interior of the glove using methods known in the art, such as stitching. The liner 117 may be integrally formed on the glove. For example, the liner (or sleeve) could be attached to the glove by standard methods, such as by conventional stitching about the perimeter of the dorsal segment, the palmar segment or both.

The lining material (or sleeve) may be comprised of standard lining materials, such as a smooth, flexible knitted fabric. The liner may also comprise of flexible and elastomeric material such as spandex or LYCRA. Other possible materials include a knit of polyester or simply the same material forming the glove. A soft cellular plastic 117 could also be preferred. Additionally, the liner may provide added features to offer warmth and comfort such as by comprising of a fleece material, for example, especially useful when competing in harsher conditions or during extended practices on the golf range, for example.

The embodiment is suitably a substantially conventionally constructed golf glove, modified as aforementioned. This particular glove can be made of any standard sports glove materials or any materials aforementioned, such as, for example, primarily a durable material 82, 81 such as a Cabretta leather latex coated glove palmar 82 and dorsal portion 81 for added durability, for example.

As aforementioned, the present invention, including this embodiment may be constructed using standard materials and methods of construction known in the art of making sports gloves. For example, construction of this embodiment may be accomplished by standard methods, such as, by designing the dorsal and palmar sections to meet along a conjoining lateral edge to define a pocket for receiving the eminence of a user's hand. Said dorsal and palmar sections could be conjoined by sewing, for example.

Figure 8:
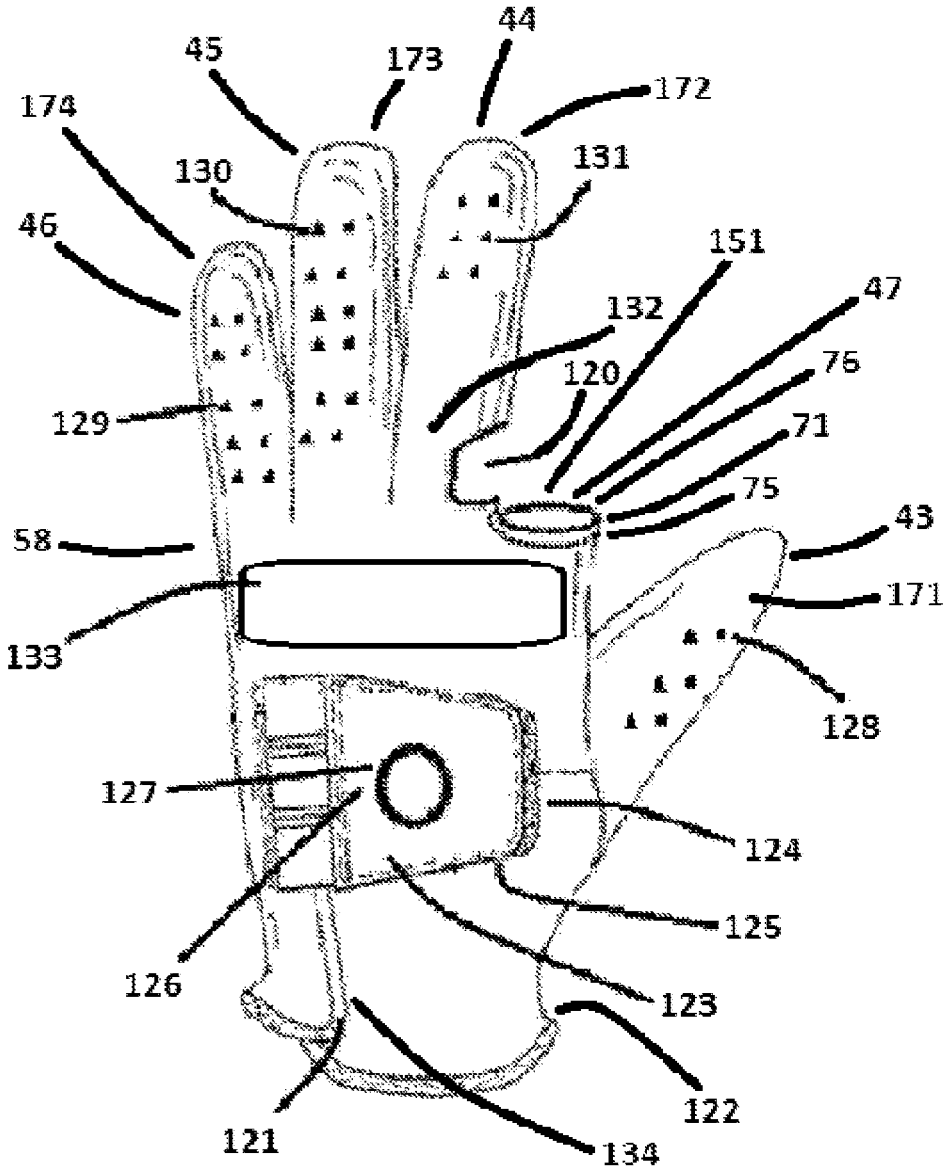
FIG. 8 is an alternative dorsal segment to FIG. 3.
Figure 18:
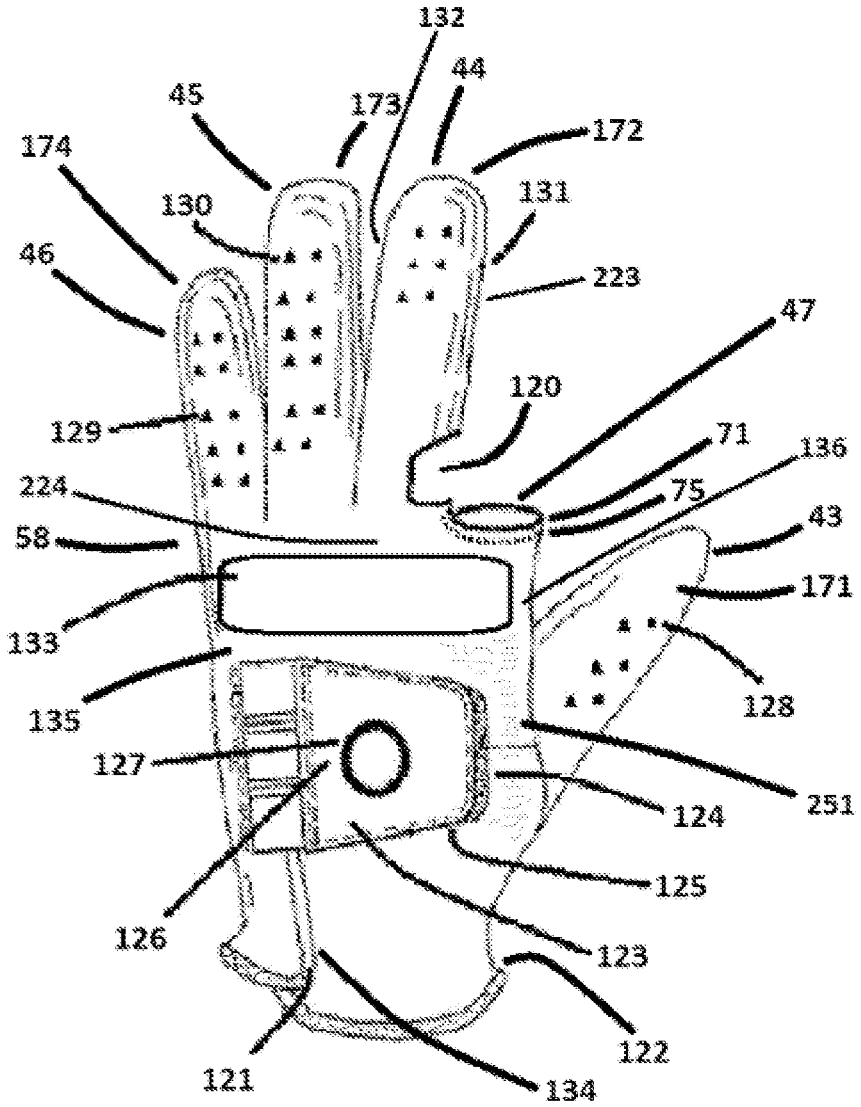
FIG. 18 is a drawing improving the palmar view of FIG. 8.

One could use any standard method of manufacture and assembly or construction. It will be apparent to one of ordinary skill in the art that many other implementations of liners are possible FIG. 8 shows an alternative dorsal segment to FIG. 3. Continuation in part improvements to the alternative dorsal segment 223, 224, 251 are shown and designated in new FIG. 18. This embodiment comprises a glove with a body comprising a palmar portion, a dorsal portion and a distal lateral edge 58, wherein the palmar portion and the dorsal portion meet at the distal lateral edge. The glove also comprises a plurality of digital segments projecting from the distal lateral edge of the body, the plurality of digital segments including a digital segment that is adapted to cover and enclose an entire thumb finger, a digital segment that is adapted to cover and enclose an entire middle finger, and a digital segment is adapted to cover and enclose an entire ring finger when the glove is worn. The glove also comprises a terminal edge 71 at the distal lateral edge of the body designed to allow a forefinger to extend past the terminal edge to completely expose the forefinger when the glove is worn, thereby providing a glove without a digital segment for a forefinger. In other words, the user's forefinger, defined by the proximal phalanx, the middle phalanx and the distal phalanx of the user's forefinger, is entirely exposed when the glove is worn.

The palmar (front) view of the glove is drawn in FIG. 3 and the dorsal (back) view of the glove is drawn in FIG. 8.

This partial-fingered embodiment provides a glove having a dorsal portion 135 and a palmar portion 42 for overlaying respective back and palm regions of a human hand, said dorsal and palmar portions having distal and proximal ends with a plurality of digital segments (or stalls) projecting from said distal ends. The glove includes a glove body having a back portion covering the dorsal surface of the hand 135, and a front portion covering essentially the entire palm surface of the hand 42. The glove body includes finger segments and a thumb segment each adapted to receive a finger or thumb, respectively, therein.

In the illustrated embodiment, the glove is constructed such that the thumb 43 digital segment encloses said thumb, including enclosing the fingertips. The glove also has a middle finger digital segment 44 that covers the middle finger, including the fingertips, a ring finger digital segment 45 that covers the ring finger, including the fingertips, and a pinkie finger digital segment 46 that covers the pinkie finger, including the fingertips of a user. This embodiment does not have a forefinger digital segment 47 therefore a user's forefinger is completely uncovered when the glove is worn. In other words, the proximal phalanx, the middle phalanx and the distal phalanx of the user's forefinger are all entirely exposed when the glove is worn however the forefinger's palm portion, or the user's forefinger metacarpal 136, is entirely covered by the glove body when the glove is worn. The terminal edge is reinforced by stitching 75. The stitching is adapted to encircle the terminal edge in order to prevent tearing.

The palmar surface of this glove embodiment therefore essentially covers the rest of the front of the hand, including the entire palm of the hand as well as all of the five metacarpals of all user's hand including the entire metacarpal of the user's forefinger 42; the dorsal section covers most of the rest of the back of the hand 135, allowing for possible micro-recesses for ventilation and the slit along the glove dorsal portion.

The thumb stall 43 is defined by a dorsal portion 171 and palmar portion 49. The middle finger stall 44 is defined by a dorsal portion 172, a palmar portion 51, a first side 131 adjacent the thumb stall, and a second side 132 adjacent the ring finger stall and opposite said first side. The ring finger stall 45 is defined by a dorsal portion 173 and a palmar portion 53. The pinkie finger stall 46 is defined by a dorsal portion 174 and a palmar portion 55. There is no forefinger stall so there is no dorsal or palmar portion defining the forefinger stall.

The embodiment further comprises an aperture 120 along the middle finger digital segment, said aperture configured to be of substantial size to expose any or all of the user's middle finger's proximal phalanx. For example, this embodiment shows an aperture that is adapted to reside along the middle finger stall to expose the user's proximal phalanx. The aperture resides primarily on the dorsal portion of the middle finger stall and extends out to the first side of the middle finger stall 131 adjacent to the thumb stall 43, thereby exposing a portion of a user's forefinger when the glove is worn.

It is important that the aperture be of substantial size to be large enough such that the skin of the wearer's middle finger can touch or be touched by an opposing hand's finger when the glove is worn. Said aperture also does not extend along any portion of the second side 132 of the middle finger stall, therefore said second side is free of such an aperture. The aperture of the embodiment also does not extend to expose the user's middle phalanx nor the user's metacarpophalangeal, thus defining the aperture's terminal edges.

In addition, the embodiment also preferably has an expandable opening means 121 at a wrist end 122 adapted to receive the user's hand. The expandable opening means comprises an elastic material such as an elastomeric band 121 fixed around the wrist to expand and contract when the glove is worn. The glove dorsal portion further comprises a strap means 123 at the open end of the glove body for fastening the glove body secure about the wrist area, critical in sports activities where the user's hand moves very rapidly such as in golf or football. The strap means may be unitary with the glove body and may include VELCRO fasteners 124, 125, buttons, and the like. The strap means may have two pads of cohesive-adhesive material for releasably securing the strap, for example. The strap means as well as the wrist portion may be sewn onto the glove. The strap means allows the user to ensure a tight fit around the user's hand so that it will not disengage from the user's hand during high velocity sport movements such as swinging a driving wood golf club or throwing a Hail Mary football pass. The strap means also allows the user to quickly engage and disengage the glove, important aspects during active sports play such as in golf and in football.

The wrist portion further comprises a slit 134. The slit allows the user to quickly take off or put on the glove, and doing so very easily. Providing a slit and a strap means is especially valuable to users who play a sport that requires the constant removal of the glove, such as in football—where players generally take off their gloves during a change of possession, and in golf—where virtually all players take off their glove when preparing to putt a golf ball.

This embodiment also comprises a detachable ball marker 126. A ball marker is often used when playing golf. During certain times, such as when reaching the green or when obstructing another player's direct path to the golf hole, the golfer may pick his ball and place a ball marker directly behind the golf ball; the golfer can then pick up the golf ball. The embodiment provides a convenient, detachable ball marker on the glove. The detachable ball marker in this embodiment is a small circular object 126. The detachable ball marker is secured by any standard fastening means, such as by snap fastening 127, by a VELCRO fastening compartment, or by magnetism.

The embodiment also provides micro recesses along the portion of the thumb stall 128, the ring finger segment 130 and pinkie finger segment 129, for ventilation.

It is commonly known that wrist bands have been constructed with perspiration absorbing capabilities, allowing an athlete to wipe perspiration away from their face during competition. Where wrist bands are not commonly used, such as in golf or football play, the athlete is currently left deficient in this area. As such, a moisture absorbent material 251 may be provided along the dorsal portion of embodiments allowing a user to wipe off perspiration commonly on a user's face during active sports play. The moisture absorbent material is thereby adapted to absorb perspiration when coming in contact with the user's face, when the glove is worn. The moisture absorbent material may be secured anywhere along the dorsal surface of the glove body. The moisture absorbent material may be formed of any moisture absorbent material aforementioned, such as, for example, about 1/12 inch or so of terry cloth 251 or absorbent foam stitched onto the dorsal surface of the glove body.

The materials forming the illustrated embodiment may comprise those discussed in reference to the present invention 135, 42. Likewise, any previously discussed methods of construction may be applied to this embodiment. This glove body material may be constructed as many standard sport gloves, such as golf gloves made primarily of a durable but flexible material 135, 42, such as leather material 135 like a Cabretta leather 135, for example, while providing a much more elastic fiber 133 such as spandex 133, along the metacarpophalangeal joints of the four fingers.

As discussed, the partially uncovered finger as well as the aperture along the middle finger segment offers maximum retention of tactile sensation. The uncovered finger portion allow the user to maximize hand coordination, for example, while the aperture allows the user to maintain maximum feel ability on the golf club—both crucial aspects in completing a successful golf swing. This unique offering will significantly increase the golfer's ability to control a golf club and also therefore a golf swing and golf ball.

Figure 9:
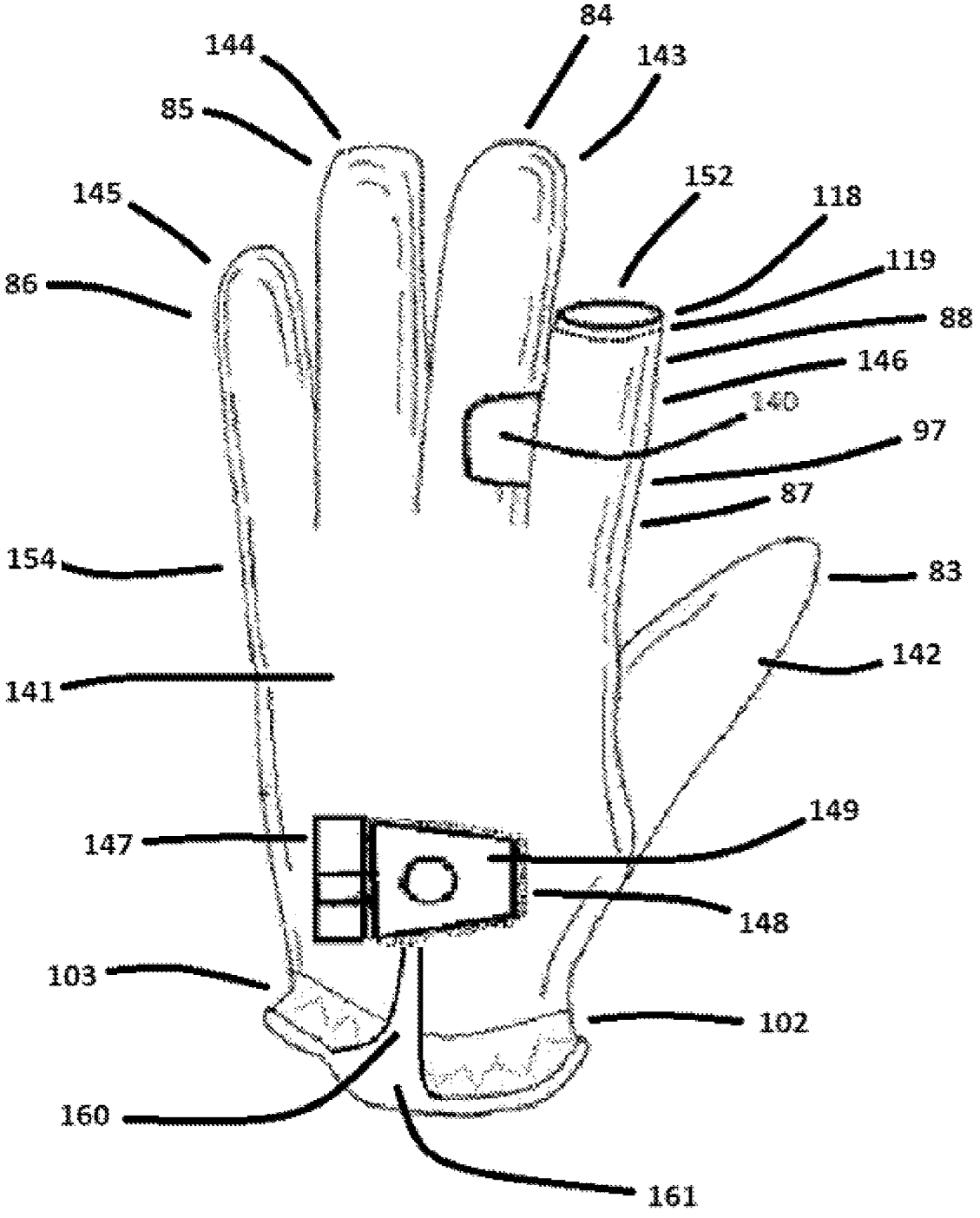
FIG. 9 is an alternative dorsal segment to FIG. 6.
Figure 19:
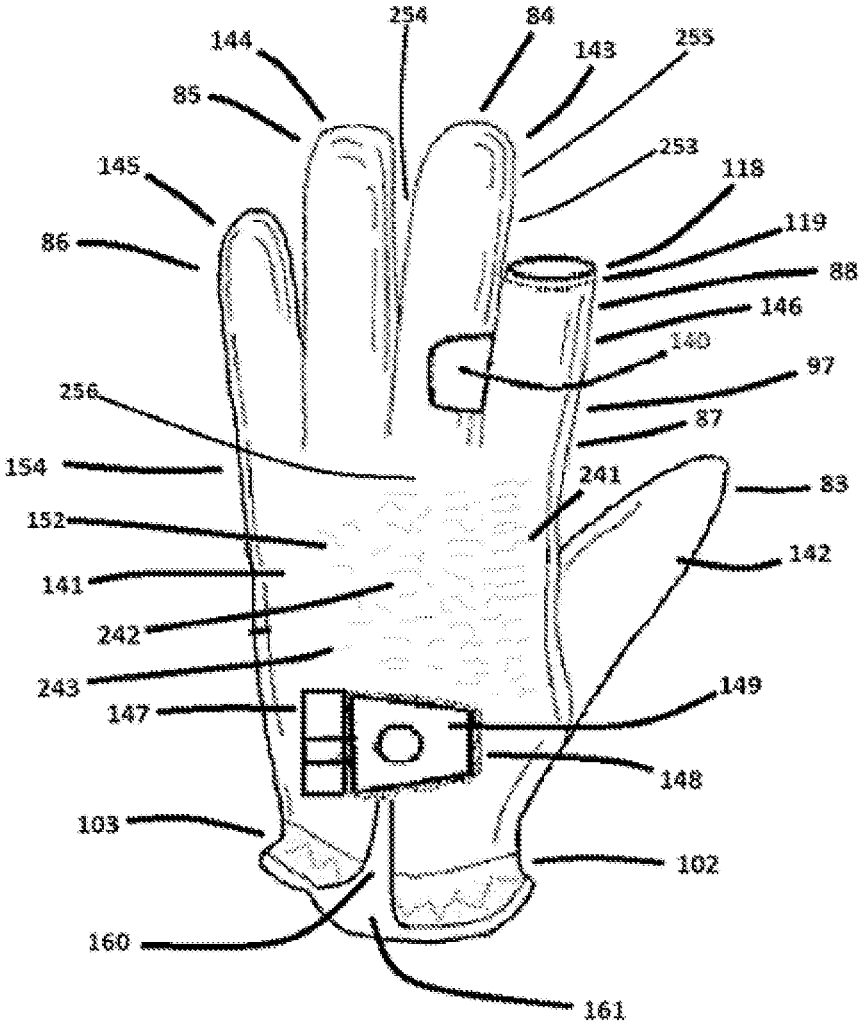
FIG. 19 is a drawing improving the dorsal view of FIG. 9.

FIG. 9 shows an alternative dorsal segment to FIG. 6. Continuation in part improvements to the alternative dorsal segment 242, 243, 256, 254, 255, 253, 241 are shown and designated in new FIG. 19. This embodiment comprises a glove with a body comprising a palmar portion, a dorsal portion and a 154 distal lateral edge, wherein the palmar portion and the dorsal portion meet at the distal lateral edge. The glove also comprises a plurality of digital segments projecting from the distal lateral edge of the body, the plurality of digital segments including a digital segment that is adapted to cover and enclose an entire thumb finger, a digital segment that is adapted to cover and enclose an entire middle finger, a digital segment that is adapted to cover and enclose an entire ring finger, and a digital segment that is adapted to cover and enclose an entire pinkie finger when the glove is worn.

The glove also comprises a partial forefinger digital segment 97 with a distal terminal edge 118 that is adapted to cover the proximal phalanx of the user's forefinger while exposing the entire distal phalanx of the user's forefinger when the glove is worn, thereby allowing heightened tactile sensitivities along the fingertip and simultaneously enhancing grip capabilities along the covered proximal phalanx of the user's forefinger. The palmar (front) view of the glove is drawn in FIG. 6 and the dorsal (back) view of the same glove is drawn in FIG. 9.

This partial-fingered embodiment provides a glove having a dorsal portion 141, a palmar portion 82 for overlaying respective back and palm regions of a human hand, said dorsal and palmar portions having distal and proximal ends with a plurality of digital segments (or stalls) projecting from said distal ends. The glove includes a glove body having a back portion covering the back of the hand 141, and a front portion covering the palm or front of the hand 82. The glove body includes finger stalls and a thumb stall each adapted to receive a finger or thumb, respectively, therein.

In the illustrated embodiment, the glove is constructed such that the thumb segment 83, middle finger segment 84, ring finger segment 85 and pinkie digital segment 86 enclose said thumb, middle finger, ring finger, and pinkie fingers including enclosing the fingertips, respectively. The glove also has a forefinger segment that covers the forefinger's entire proximal phalanx 87. The forefinger segment also covers the forefinger's middle phalanx 88 but does not extend to cover any portion of the forefinger's distal phalanx; a user's forefinger's fingertips are therefore exposed.

The palmar section covers the entire palm of the hand 82 and the dorsal section covers the back of the hand 141. The glove also has a wrist portion that surrounds the wrist of a user.

The thumb stall 83 is defined by a dorsal portion 142 and a palmar portion 90. The middle finger stall 84 is defined by a dorsal portion 143, a palmar portion 92, a first side 253 adjacent the forefinger stall, and a second side 254 adjacent the ring finger stall and opposite said first side The ring finger stall 85 is defined by a dorsal portion 144 and a palmar portion 94. The pinkie finger stall 86 is defined by a dorsal portion 145 and a palmar portion 96. The forefinger stall 97 is defined by a dorsal portion 146 and a palmar portion 100. The palmar portion of the glove covers all five palm's five metacarpals of the user's palm, when the glove is worn.

The wrist portion is preferably expansible so as to hold more securely to the user's wrist. Therefore the embodiment also has an expandable opening means at a wrist end 102 adapted to receive the user's hand. The expandable opening means comprises an elastic material along the wrist portion, such as an elastomeric band 103 fixed around throughout the wrist. In addition, the glove further comprises a strap means 147 at the open end of the glove body dorsal portion for fastening the glove body secure about the wrist area, critical in sports activities where the user's hand moves very rapidly such as in golf or football. The strap means may be unitary with the glove body and may include VELCRO fasteners 148, 149, buttons, and the like or other suitable closures thereon. The strap means allows the user to ensure a tight fit around the user's hand so that it will not disengage from the user's hand during high velocity sport movements such as swinging a driving wood golf club or throwing a Hail Mary football pass. The strap means also allows the user to quickly engage and disengage the glove, important aspects during active sports play such as in golf and in football. The wrist portion further comprises a slit 160. The slit allows the user to quickly take off or put on the glove, and doing so very easily.

Providing both a slit and a strap means is especially valuable to users who play a sport that requires the constant removal of the glove, such as in football—where players generally take off their gloves during a change of possession, and in golf—where virtually all players take off their glove when preparing to putt a golf ball. The strap means is adapted to allow the user to mechanically stretch the strap means across the slit and fasten the glove to the user's hand.

It is commonly known that wrist bands have been constructed with perspiration absorbing capabilities, allowing an athlete to wipe perspiration away from their face during competition. Where wrist bands are not commonly used, such as in golf or football play, the athlete is currently left deficient in this area. As such, a moisture absorbent material 152 may be provided along the dorsal portion of embodiments allowing a user to wipe off perspiration commonly on a user's face during active sports play. The moisture absorbent material is thereby adapted to absorb perspiration when coming in contact with the user's face, when the glove is worn.

The moisture absorbent material may be secured anywhere along the dorsal surface of the glove body, such as along the glove material overlaying the metacarpals of the user's forefinger 241, middle finger 242, and ring finger 243. The moisture absorbent material may be formed of any moisture absorbent material aforementioned, such as, for example, about 1/12 inch or so of terry cloth 152 or absorbent foam stitched onto the dorsal surface of the glove body.

Additionally, embodiments may offer a liner is fixed to the interior of the glove using methods known in the art, such as stitching. The liner 161 may be integrally formed on the glove. For example, the liner (or sleeve) could be attached to the glove by standard methods, such as by conventional stitching about the perimeter of the dorsal segment, the palmar segment or both.

The lining material (or sleeve) may be comprised of standard lining materials, such as a smooth, flexible knitted fabric. The liner may also comprise of flexible and elastomeric material such as spandex or LYCRA. Other possible materials include a knit of polyester or simply the same material forming the glove. A soft cellular plastic could also be preferred. Additionally, the liner may provide added features to offer warmth and comfort such as by comprising of a fleece material, for example, especially useful when competing in harsher conditions or during extended practices on the golf range, for example. It will be apparent to one of ordinary skill in the art that many other implementations of liners are possible.

The embodiment further comprises an aperture 140 along the middle finger digital segment such that it exposes at least a portion of the middle finger's proximal phalanx when the glove is worn. Specifically, the embodiment shows an aperture that extends along the middle finger digital segment such that it exposes the user's proximal and middle phalanx. It is critical that the aperture is large enough such that the skin of the middle finger may touch or be touched by the pinkie finger of the user's opposing hand, for example, while gripping a golf club. In other words, the embodiment shows an aperture that resides along the middle finger stall to expose at least a portion of the user's proximal and middle phalanges, and is of substantial size to be large enough such that the skin of the middle finger can touch or be touched by the pinkie finger of the user's opposing hand, such as, while gripping a golf club. As shown, the aperture resides primarily on the dorsal portion and extends out to the first side of the middle finger stall 253 adjacent to the forefinger stall 97. Said aperture does not extend along any portion of the second side 254 of the middle finger stall, therefore said second side is free of any said aperture. Furthermore, the aperture also does not extend to expose the user's distal interphalangeal or distal phalanx 255, nor the user's metacarpophalangeal 256, thus defining its terminal edges.

It is important that the aperture be of substantial size to be large enough such that the skin of the wearer's middle finger can touch or be touched by an opposing hand's finger when the glove is worn in order to effectively and substantially enhance tactile sensitivities such as when playing golf for example.

The materials forming the illustrated embodiment may comprise those discussed in reference to the present invention. Likewise, any previously discussed methods of construction may be applied to this embodiment.

Figure 20:
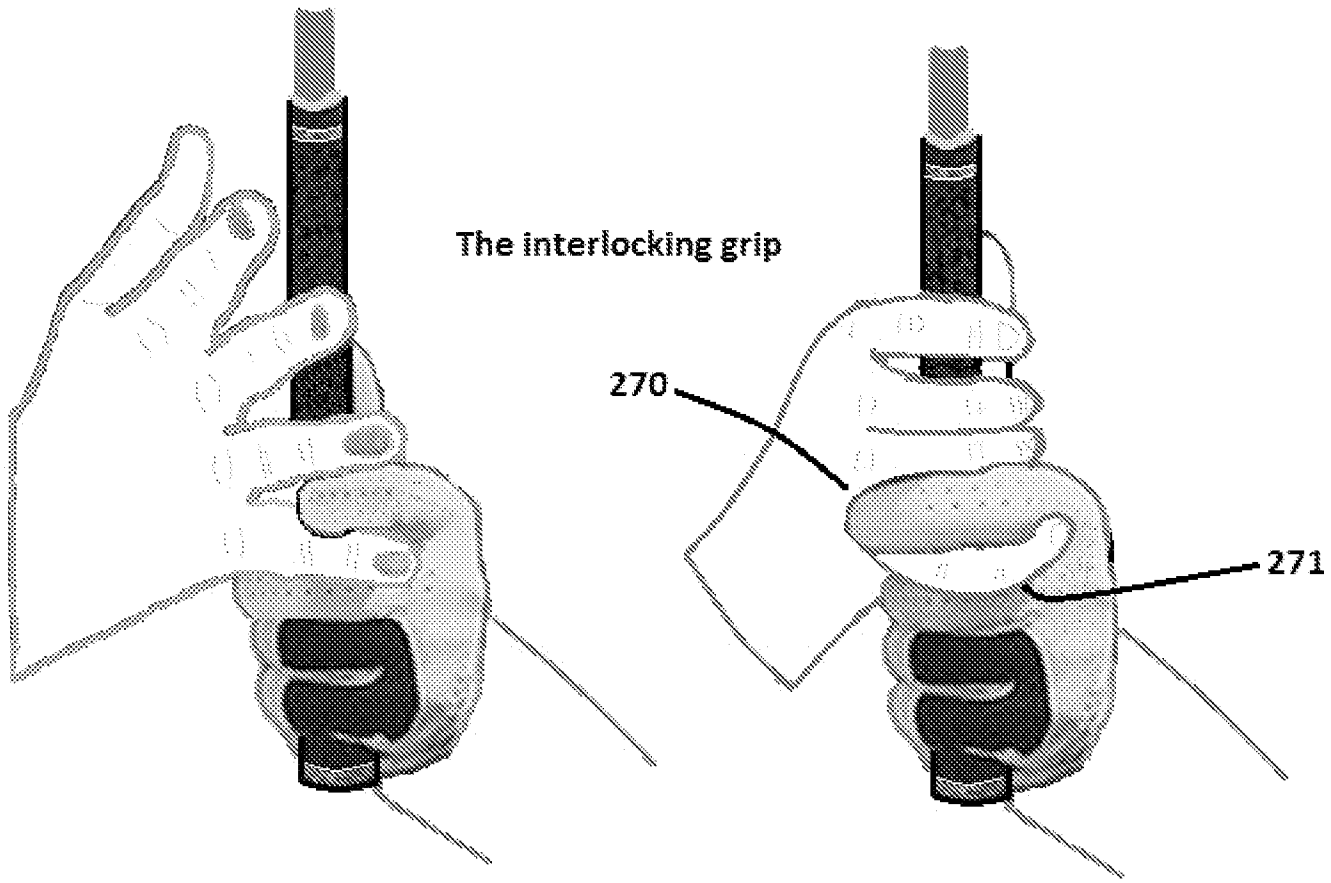
FIG. 20 shows a typical interlocking grip using a conventional prior art glove.

FIG. 10 is a related art drawing of a typical interlocking grip using prior art gloves. Continuation in part improvements to the related art drawing 270, 271 is shown and designated in new FIG. 20. As can be seen, the dominant hand's pinkie finger interlocks with the user's weak hand forefinger. The golfer is using the conventional golf glove on the weak hand. Substantially increased hand coordination of the user's golf swing is achieved by allowing skin-to-skin contact between the user's two hands. Exposing the user's fingertip of the user's forefinger would allow the skin of said fingertip to touch the skin of the opposing hand's back of the hand 270. Additionally, providing an aperture along the user's middle finger stall 271 would also allow skin-to-skin contact between the user's middle finger with the opposing hand's ungloved pinkie finger.

I claim:

1. A glove comprising:

a body comprising a palmar portion, a dorsal portion and a distal lateral edge, wherein the palmar portion and the dorsal portion meet at the distal lateral edge;

a plurality of digital segments projecting from the distal lateral edge of the body, the plurality of digital segments comprise a first digital segment, a second digital segment a third digital segment, and a fourth digital segment adapted to entirely cover a pinkie, a ring finger a middle finger and a thumb respectively;

wherein said plurality of digital segments further comprises a fifth digital segment that is adapted to overlay an entire proximal phalanx of a forefinger of the user's hand; and wherein said fifth digital segment is adapted to expose a distal phalanx of the forefinger of the user's hand, thereby exposing a fingertip of the user's forefinger when the glove is worn; and, wherein said glove body further comprises of an open end wrist portion having a strap means adapted for fastening the glove body secure about a wrist area; and, wherein the dorsal portion of the glove further comprises a slit;

wherein said strap means is adapted to extend across said slit; and, wherein said glove palmar portion further comprises a grip enhancing means whereby said grip enhancing means is adapted to provide a higher coefficient of friction than a material forming the palmer portion of the glove body.

2. The glove of claim 1, wherein said grip enhancing means is adapted to overlay the palmar portion of the user's thumb when the glove is worn.

3. The glove of claim 1, wherein the palmar portion comprises a plurality of projections or a plurality of depressions designed to provide grip when gripping a golf club.

4. The glove of claim 1, wherein the palmar portion further comprises a grip enhancing means that is adapted to overlay a metacarpophalangeal of the user's forefinger;

wherein said grip enhancing means creates a higher coefficient of friction than a surrounding glove palmar portion;

wherein said grip enhancing means is adapted to not extend beyond said metacarpophalangeal of the user's forefinger.

5. The glove of claim 1, wherein the palmar portion further comprises one of a panel, a plurality of projections and a plurality of depressions adapted to grip a golf club, wherein depths of the depression or heights of the projections are designed to form a gap that provides movement of palmar surfaces relative to the golf club, wherein the depths or heights range between 100 micrometers to 5 millimeters.

6. The glove of claim 1, wherein said strap means consists of two pads of cohesive-adhesive material for releasably securing the strap.

7. The glove of claim 1, wherein the palmar portion further comprises a grip enhancing means consisting of a grip enhancing panel that is adapted to overlay at least a metacarpophalangeal joint of the user's forefinger.

8. The glove of claim 1, wherein the grip enhancing means comprises a grip enhancing panel that is adapted to overlay at least a metacarpophalangeal joint of the user's forefinger when the glove is worn; and, wherein said grip enhancing panel overlaying the metacarpophalangeal comprises a tackified material.

9. The glove of claim 1, further comprising the grip enhancing means comprising a plurality of depressions; and, wherein said grip enhancing means is adapted to overlay the metacarpophalangeal joint of the user's forefinger, middle finger, ring finger and pinkie finger when the glove is worn.

10. The glove of claim 1, further comprising micro-recesses designed to provide ventilation, wherein the micro-recesses have a diameter of approximately 0.120 millimeters.

11. A sports glove comprising:

a body comprising a palmar portion, a dorsal portion and a distal lateral edge, wherein the palmar portion and the dorsal portion meet at the distal lateral edge;

a plurality of digital segments projecting from the distal lateral edge of the body, the plurality of digital segments comprise a first digital segment, a second digital segment and a third digital segment adapted to entirely cover a pinkie, a ring finger and a thumb respectively;

wherein said plurality of digital segments further comprises a fourth digital segment that is adapted to overlay an entire proximal phalanx of a forefinger of the user's hand; and wherein said fourth digital segment is adapted to expose at least an entire distal phalanx of the forefinger of the user's hand, thereby exposing a fingertip of the user's forefinger when the glove is worn; and, wherein said glove body further comprises of an open end wrist portion having a strap means adapted for fastening the glove body secure about the wrist area; and, wherein said dorsal portion further comprises a moisture absorbent material that is secured along a surface of the dorsal portion of the glove body that is adapted to absorb perspiration when coming in contact with the user's face, when the glove is worn.

12. The glove of claim 11, wherein said moisture absorbent material is secured along the glove material overlaying the metacarpals of the user's forefinger when the glove is worn.

13. The glove of claim 11, wherein said moisture absorbent material is secured along the glove material overlaying a metacarpals of the user's forefinger and middle finger when the glove is worn; and, wherein said moisture absorbent material comprises a terry cloth.

14. The glove of claim 11, wherein the glove comprises a grip enhancing means that is adapted to overlay the user's thumb when the glove is worn; and, wherein said grip enhancing means comprises a tackifier or tackified material.

15. The glove as claimed in claim 11, wherein said glove further comprises the grip enhancing means consisting of a grip enhancing panel that is adapted to overlay at least a metacarpophalangeal joint of the user's forefinger; and, wherein said grip enhancing panel comprises a tackified material.

16. The glove of claim 11, wherein the grip enhancing means is adapted to overlay a metacarpophalangeal of the user's forefinger;

wherein said grip enhancing means creates a higher coefficient of friction than a surrounding glove palmar portion;

wherein said grip enhancing means is adapted to provide a Shore A Durometer Coefficient of Friction of 1.0 or greater.

17. A golf glove comprising:

a body comprising a palmar portion, a dorsal portion and a distal lateral edge, wherein the palmar portion and the dorsal portion meet at the distal lateral edge;

a plurality of digital segments projecting from the distal lateral edge of the body, the plurality of digital segments including a digital segment that is adapted to cover and enclose an entire thumb finger, a digital segment that is adapted to cover and enclose an entire middle finger, and a digital segment is adapted to cover and enclose an entire ring finger when the glove is worn; and wherein said glove body further comprises a terminal edge at the distal lateral edge of the body that is designed to allow a forefinger to extend past the terminal edge and completely expose the forefinger when the glove is worn, thereby providing a glove without a digital segment for a forefinger; and wherein the glove body is stitched along the distal terminal edge to minimize tearing along the distal terminal edge; and, wherein said glove body further comprises an open end wrist portion having a strap means adapted for fastening the glove body secure about a wrist area; and, wherein said glove palmar portion further comprises a grip enhancing means whereby said grip enhancing means is adapted to provide a higher coefficient of friction than a material forming the palmer portion of the glove body.

18. The glove of claim 17, wherein said grip enhancing means is adapted to overlay a palmar portion of the user's thumb when the glove is worn.

19. The glove of claim 17, wherein said glove dorsal portion comprises an aperture that is adapted to extend across the glove body middle finger digital segment;

wherein said aperture is adapted to expose a proximal phalanx of the user's hand when the glove is worn.

20. The glove of claim 17, wherein the palmar portion further comprises a grip enhancing means that is adapted to overlay at least a metacarpophalangeal of the user's forefinger;

wherein said grip enhancing means creates a higher coefficient of friction than a surrounding glove palmar portion;

wherein said grip enhancing means consists of a grip enhancing panel.

* * * * *